US006310833B1

(12) United States Patent
Guyett et al.

(10) Patent No.: US 6,310,833 B1
(45) Date of Patent: Oct. 30, 2001

(54) INTERACTIVE VOICE RECOGNITION DIGITAL CLOCK

(75) Inventors: Thomas G. Guyett, Gainesville; Michael H. Reeves, Athens, both of GA (US); Stephen B. Hobbs, Kentwood, MI (US)

(73) Assignee: Salton, Inc., Lake Forest, IL (US)

( * ) Notice: Subject to any disclaimer, the term of this patent is extended or adjusted under 35 U.S.C. 154(b) by 0 days.

(21) Appl. No.: 09/451,663

(22) Filed: Nov. 30, 1999

(51) Int. Cl.[7] ..... G04B 21/08
(52) U.S. Cl. ..... 368/63
(58) Field of Search ..... 368/63, 245, 250, 368/151.2, 151.3, 151.1, 262

(56) References Cited

U.S. PATENT DOCUMENTS 2,856,751 * 10/1958 Preiser ..... 58/19
3,681,916 * 8/1972 Itoyama ..... 58/39
3,855,574 * 12/1974 Welty ..... 340/148
4,038,561 * 7/1977 Lorenz ..... 307/141
4,205,517 * 6/1980 Murakami ..... 368/245
4,419,770 * 12/1983 Yagi ..... 455/301
4,426,733 * 1/1984 Brenig ..... 455/79
4,470,706 * 9/1984 Nishimura ..... 368/74
4,635,286 * 1/1987 Bui ..... 381/43
5,666,331 * 9/1997 Kollin ..... 368/245
5,794,205 8/1998 Walters et al. .

* cited by examiner

*Primary Examiner*—Bernard Roskoski
(74) *Attorney, Agent, or Firm*—Sonnenschein Nath & Rosenthal

(57) ABSTRACT

An Interactive Voice Recognition and Speech Synthesis Clock Radio wherein the voice recognition circuitry is trained to recognize a number of predetermined phrases spoken by one or more specific users. The speech synthesis circuitry includes a number of predetermined phrases generated in response to verbal utterances by a user.

26 Claims, 16 Drawing Sheets

RETRAIN

INTERACTIVE VOICE RECOGNITION DIGITAL CLOCK

BACKGROUND OF THE INVENTION

1. Field of the Invention

The present invention relates to clocks and clock radios, and more specifically to interactive voice controlled clocks and clock radios. The methods and apparatus of the invention provide for setting substantially all initial parameters for a clock or clock radio, including the time, alarm, radio frequency, etc., by voice command, and also provides for synthesized speech to indicate the present time, alarm set time, radio frequency, etc., to the user.

2. Description of Related Art Including Information Disclosed Under 37 CFR 1.97 and 1.98

Over the years the modem world has required higher and higher levels of interaction and interdependence of mankind. In addition, people seem to be performing many more of their activities or tasks during both the day and night. To be able to get all of these tasks and activities accomplished, a greater and greater premium has been placed on punctuality. For example, most activities start at a preset time and tardiness with respect to the activity may have little effect or sometimes disastrous effects. In addition, because of the international element of business, some business meetings such as teleconferencing may take place at any time during the 24 hour day, and travel or transportation for meetings, vacations, etc., may also start and/or terminate at almost any hour.

In any event, time awareness cannot be avoided and the problem of being awakened from a sound sleep has become more and more critical. At the same time, since being awakened artificially almost every morning has become commonplace, clocks used for awakening someone have evolved from the strident sound of the "alarm clock" to the more acceptable and less traumatic wakening to music, news or other pleasant sounds. Modem digital alarm clocks or clock radios also provide LED's (light emitting diodes) for visual indication even at night. Also, of course, energy conservation in every field is encouraged and some types of clocks such as analog quartz clocks or electronic digital clocks are specifically desirable as they typically have long life and require very little energy to function. Unfortunately, even though the total amount used is small, they do require a constant supply of electrical power to run, and an uninterrupted source of power if they are to remain accurate. Such power sources simply do not exist. Batteries in battery powered devices or clocks run out or "die" and commercially available line AC power supplied to the home and business are occasionally interrupted by a myriad of causes. In addition, techniques for improving the efficiency and dependability of time keeping systems such as alarm clocks, clock radios, etc., are always being sought.

For example, U.S. Pat. No. 4,697,930 to Roberts et al. and entitled "Transformerless Clock Circuit With Duplex Optoelectronic Display" discloses a transformerless power supply and display energizing circuit for a clock circuit with a duplex optoelectronic display driven by low voltage integrated clock circuit having positive and negative voltage input terminals and the duplex display having a first terminal connected to a first common cathode and a second terminal connected to a second common cathode of the display. The transformerless circuit is powered from an AC source. An impedance, which may be either resistive or reactive, reduces the AC voltage to a level suitable for the integrated clock circuit. The transformerless circuit also generates synchronous DC level-shifted pulse trains for driving the positive input terminal of the integrated clock circuit alternately between a first voltage and a reference voltage while synchronously driving the display first terminal between the first voltage and a voltage of equal amplitude and opposite polarity.

U.S. Pat. No. 4,595,861, issued to Simopoulos et al. and entitled "Power Supplies for Electroluminescent Panels" discloses circuitry for converting a DC power supply to an AC power supply for electroluminescent lamps which are self-inhibited from further oscillations and are current limited in the event that a failure occurs in an EL (electroluminescent) lamp which results in the EL lamp being shorted. According to one embodiment of this patent, a single ended and push/pull transformer power supply is disclosed and according to a second embodiment, a transformerless solid state power supply is disclosed. The solid state power supply uses a voltage multiplier to increase the AC or square wave voltage to a level of almost 140 volts for powering the EL lamp. Thus, it is seen that the circuitry in this patent discloses techniques for converting from DC power to AC power, not AC power to DC power and further provides circuitry to inhibit oscillations and operations of the circuitry in the event of a shorting of the EL lamp or a substantial voltage drop.

U.S. Pat. No. 4,201,039, to Roland M. Marion and entitled "Numerical Display Using Plural Light Sources and Having a Reduced and Substantially Constant Current Requirement" discloses a numerical digital display having a reduced DC current requirement per character display site. The circuitry is useful for powering a digital display in an AC powered clock or clock radio in which it is desirable to keep the DC current requirement of the display to a substantially constant minimum suitable for use with a low cost transformerless power supply conventional with radio receivers. The current requirements of the digital character display site is reduced over that of full parallel operation by selectively serializing certain light sources in a manner leaving the display control circuitry uncomplicated by permitting each light source state to be controlled by a shunt control switch sharing a common bus. The shunt control, which diverts rather than prevents current flow in the display, allows the display current to remain substantially constant irrespective of the digital numbers displayed.

U.S. Pat. No. 4,109,180 to Ogle et al., and entitled "AC-Powered Display System With Voltage Limitation" discloses an AC-powered display system which includes a gas discharge display panel, an integrated circuit, and a limiting network. The integrated circuit is provided as a display pattern controller and may also comprise a digital alarm clock circuitry which provides outputs for controlling the gas discharge display panel. The circuitry also includes a limiting network which reduces the current through the system in response to an excessive voltage across the controller.

U.S. Pat. No. 4,063,234 to Arn et al. and entitled "Incandescent, Flat Screen, Video Display" discloses a flat screen video display comprising a plurality of incandescent lamps arranged in an addressable X-Y matrix. The circuitry also provides a memory and driver circuit for each individual incandescent lamp for use in a flat screen video display apparatus.

U.S. Pat. No. 3,602,795 to John B. Gunn and entitled "Transformerless Power Supply" discloses circuits for converting an input voltage from a high amplitude to a lower amplitude DC voltage.

As electronic devices, including devices such as clocks and clock radios and radios, have included more and more features, controlling them has become more and more complex. Therefore, a simple and direct method of control would be advantageous. In addition, modern society now also recognizes that many people who may be blind or physically handicapped by missing, crippled, or otherwise non-functioning hands still have much to give to society. Therefore, methods and apparatus for providing these people more control of their daily life activities is certainly desirable. The simple act of being able to set an alarm or a radio station, may become difficult for someone without the use of hands. Likewise, although some braille watches and other timekeeping devices are available for the blind, the ability to audibly hear the present time to the minute would also be desirable.

The use of presently available speech synthesis clocks are a start to this problem, however, they simply are not sufficient. More elaborate real-time voice recognition and synthesized speech requires huge amounts of computational power and memory such that presently available synthesis and recognition systems have been far too expensive to consider for clocks, clock radios and the like.

Some examples of new technology include four U.S. Pat. Nos. (4,214,125; 4,314,103; 4,384,169; and 4,384,170) to Forrest S. Mozer alone or with Richard P. Stauduhur as co-inventor all based on the same specification which is set out in full in the 4,214,125 patent, and is incorporated by reference in its entirety herein. These patents disclose methods and apparatus for analyzing and synthesizing speech information in which a predetermined vocabulary is spoken into a microphone. The resulting electrical signals are differentiated with respect to time, digitized, and a digitized waveform is appropriately expanded or contracted by linear interpretation so that the pitch periods of all such waveforms have a uniform number of digitizations and the amplitudes are normalized with respect to a reference signal. These "standardized" speech information digital signals are then compressed in the computer by subjectively removing and discarding redundant speech information such as redundant pitch periods, portions of pitch periods, redundant phonemes and portions or phonemes, redundant amplitude information (delta modulation) and phase information (Fourier transformation). The compression techniques are selectively applied to certain of the speech information signals by listening to the reproduced, compressed information. The resulting compressed digital information and associated compression instruction signals produced in the computer are thereafter injected into the digital memories of a digital speech synthesizer where they can be selectively retrieved and audibly reproduced to recreate the original vocabulary words and sentences from them.

U.S. Pat. No. 5,790,754 issued to Mozer et al. and entitled "Speech Recognition Apparatus For Consumer Electronic Applications" discloses a spoken word or phrase recognition device which does not require a digital signal processor, large RAM, or extensive analog circuitry. The input audio signal is digitized and passed recursively through a digital difference filter to produce a multiplicity of filtered output waveforms. These waveforms are processed in real time by a microprocessor to generate a pattern that is recognized by a neural network pattern classifier that operates in software in the microprocessor.

U.S. Pat. No. 5,657,380 issued to Todd F. Mozer and entitled "Interactive Door Answering and Messaging Device With Speech Synthesis" discloses an automatic door answering and message system having an interior unit and an exterior unit that communicate via an RF link. The system uses voice recognition and synthesis to interact with visitors. In addition to playing messages to and recording messages from visitors, the system broadcasts to the inside the responses to predetermined queries, thereby permitting a resident to screen visitors in secret. Programmed dialog scripts control the automated interaction between the machine and visitors. The system also has an intercom feature that enables the resident to talk with a visitor without opening the door. When the intercom is turned on any automatic dialog script is interrupted. The system also includes a sensing means for sensing the open/closed state of the door so that any automated dialog script is interrupted by the opening of the door.

U.S. Pat. No. 5,022,071 issued to Mozer et al. and entitled "Two-Way Voice and Digital Data Analyzer for Telephones" discloses methods and apparatus which allow the sending or receiving of either speech or digital data calls over a phone line by correctly connecting either a digital data machine or a voice phone with the line without human involvement. An analyzer connected to the phone line interrogates each incoming call to determine if it is a voice call or a digital data call. If it is a voice call, the analyzer rings the phone and connects it to the line when the phone is answered. If the incoming call is a digital data call, the data machine, such as a fax, is connected to the phone line. The distinction between voice and digital data calls is based in part on analysis of incoming response to an interrogation of the caller with messages from a speech synthesizer. For outgoing calls, the analyzer determines which of the phone and the data machines becomes active and connects the active one with the phone line while it blocks access to the line by the other one until the outgoing call is complete. A line manager is employed for the voice phones connected to the line upstream of the analyzer so it too is connected or disconnected from the line during the appropriate times.

U.S. Pat. No. 4,435,831 issued to Forrest S. Mozer and entitled "Method and Apparatus For Time Domain Compression and Synthesis of Unvoiced Audible Signals" discloses compression and synthesis techniques and related apparatus for time domain signals. It is specifically related to signals whose information content resides in the power spectrum such as speech and more particularly signals whose amplitude is aperiodic, such as unvoiced speech sounds. Compression techniques include eliminating serially redundant segments of information. Synthesis particularly of unvoiced sounds which are sensitive to injected artificial periodicity, involves repeating sequential portions of the same segment representative of the sound signal, including commencing and terminating at different points of each repetition, varying the length of the portion and reproducing the portion forward and backward in time.

U.S. Pat. No. 4,433,434 issued to Forrest S. Mozer and entitled "Method and Apparatus For Time Domain Compression and Synthesis of Audible Signals" discloses compression and synthesis techniques and related apparatus for time domain signals, particularly signals whose information content resides in the power spectrum such as speech. Compression techniques include adjusting the phase of harmonic components of a signal unit to obtain an equivalent power spectrum signal of a minimum number of discreet levels.

U.S. Pat. No. 5,008,865 issued to Shaffer et al., discloses a method of awaking a sleeper by increasing the intensity or light level of a lamp slowly and smoothly over a period of time selected by the user. The circuitry incorporates an optocoupler to control the firing angle of a triac.

SUMMARY OF THE INVENTION

The present invention discloses methods and apparatus for providing an interactive voice recognition and voice synthesis digital clock comprising a DC power source for converting AC power to DC power for powering a variety of electronic components. A microphone is included for converting audible human speech into electrical signals representing such human speech. There is also included a source of periodic pulse signals for use as clocking signals for both the digital clock and for clocking signals for a microprocessor. The microprocessor is connected to the microphone, the clocking pulse signals and the DC power source and includes the clocking circuitry for providing electrical output signals for controlling the digital clock output. The microprocessor further includes speech receiving circuitry for receiving electrical signals representative of the human speech from the microphone and for recognizing predetermined input speech phrases contained in the speech from the microphone. The recognized speech phrases are converted by the microprocessor into input electrical signals which control the selected functions of the clocking circuitry. The microprocessor also includes speech synthesis circuitry for generating electrical signals representative of selected output speech phrases in response to the received electrical signals from the microphone which represented human speech. There is also included a first memory means connected to the microprocessor which stores data required by the microprocessor to process the received speech and to determine if at least a part of the received speech represents at least one of the predetermined input speech phrases. A second memory connected to the speech synthesized circuitry of the microprocessor stores data required by the microprocessor to generate the electrical signals representative of the output speech phrases. A sound producing device such as a loudspeaker connected to the microprocessor for receiving the electrical signals from the speech synthesis and representative of the selected output speech phrases converts the electrical signals into audible sounds representative of a chosen output phrase. Finally, there is included a digital display for receiving the electrical output signals from the clocking circuit and for providing a clock display. In a preferred embodiment, the clocking circuitry of the device also generates at least one "on" signal at a selected time for use to trigger an alarm. Thus, the circuitry further comprises an alarm device connected to the microprocessor for generating electrical alarm signals in response to the "on" control signal which electrical alarm signals are connected to the speaker system so as to provide an audible sound alarm. It will be appreciated of course that the audible sound or alarm is preferably a radio, a CD player or any other pleasant source of sound. In an even further embodiment of the present invention, the microprocessor also includes radio control circuitry for generating control signals for turning the radio on and off and for tuning the radio to selected stations in response to the microprocessor receiving selected ones of the predetermined input speaker speech phrases. Also a common household electrical outlet can be provided for connecting a lamp. The lamp may then be controlled to turn on at a low level and continuously increase in brightness to a maximum.

BRIEF DESCRIPTION OF THE DRAWINGS

These and other features of the present invention will be more fully disclosed when taken in conjunction with the following Detailed Description of the Invention in which like numerals represent like elements and in which.

DESCRIPTION OF THE INVENTION

Figure 1:
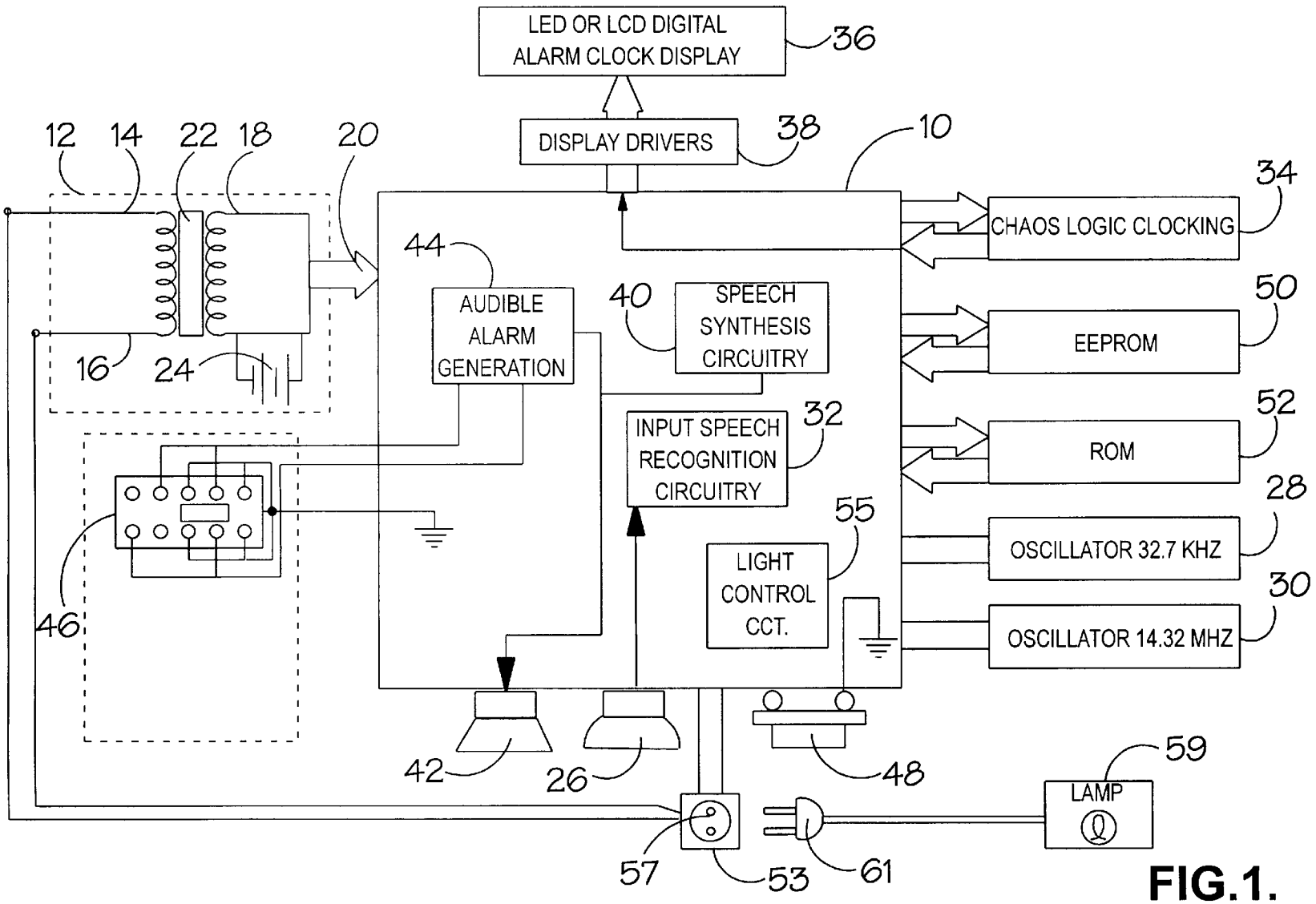
FIG. 1 is a block diagram of an interactive alarm clock incorporating the teachings of the present invention.

Referring now to FIG. 1, there is shown a block diagram of the interactive voice recognition digital alarm clock incorporating the teachings of the present invention. As shown, the interactive alarm clock includes a microprocessor 10 such as a high performance microprocessor available from Sensory Circuit Corp. of Sunnyvale, Calif. Microprocessor 10 receives a regulated squrce of DC power from power supply 12. As shown, power supply 12 includes a pair of line terminals 14 and 16 for receiving standard commercially available 115VAC power. It will be appreciated, of course, that the designation of 115VAC is for convenience only. As is well known in the art, the AC voltage into a home or other building may easily vary between 110 to 120 volts and sometimes even less than 110 volts or even slightly more than 120 volts. The 115VAC power is converted to a suitable DC power level by the power circuitry 18 and has a power output 20. It will be appreciated that the conversion of the power may take place by a transformer 22 along with rectifying circuitry (not shown) in power circuitry 18. In the embodiment shown, there is also a battery backup 24 which assures power to the microprocessor in the event of the failure of the 115VAC input power. Other types of power conversion techniques may equally be suitable for the present invention including the power supply technique described in the co-pending application entitled "Transformerless Quartz Analog Clock" and having inventors Tom Guyett, Mike Reaves and Brantley Hobbs and assigned to the same Assignee as the present invention. The teachings of this co-pending application are incorporated in their entirety herein. Preferably, the battery 24 used for a backup source of power is a NiCad (Nickel Cadmium) battery which can withstand overcharging without overheating and even destruction of the battery and damage to the clock audio circuitry. For purposes that will be discussed in detail hereinafter, there is also provided a microphone 26 for converting audible human speech into electrical signals representing such human speech. In addition, there is included a crystal oscillator 28 for providing a frequency of about 32.7 kHz for providing timing pulse to clocking circuit 34. Another crystal oscillator 30 is shown connected to microprocessor 10 and generates a pulse input having a frequency of 14.32 mHz. Oscillator 30 provides the necessary pulsing clock signals used by the microprocessor for its basic clock cycles. Microprocessor 10 is selected and programmed to provide many of the functions of the present invention and in particular includes a speech receiving circuitry 32 which receives signals from the microphone 26 and then analyzes this received speech to determine the presence of any predetermined input speech phrases which represent commands or instructions to the interactive clock system of this invention. In the event the audible human speech picked up by microphone 26 includes one of the predetermined input speech phrases, input speech circuitry 32 then generates appropriate electrical output signals for controlling selected functions of a clocking circuit 34. Clocking circuitry 34 provides the electrical signals for controlling a digital clock display 36. In the embodiment shown in FIG. 1, clocking circuitry is shown as a separate unit outside of microprocessor 10. However, it will be appreciated that clocking circuitry 34 could be a portion of microprocessor 10 programmed to generate the necessary clocking signal. Digital clock display 36 may typically be an LED (light emitting diode) or LCD (liquid crystal display) digital clock display. The digital clock display will provide a 4-digit, 24 hour or alternately, an AM/PM 12 hour display which uses 2 digits for showing hours and 2 digits for showing minutes. The display will also provide other sources of information such as, for example, whether or not one or more alarm functions are set, a separator between hours and minutes, and an indicator of AM or PM in the event a 12 hour display is used. As will be appreciated by those skilled in the art, clocking circuitry 34 will not typically provide its output signals directly to the clock display 36 but will provide signals to the display drivers 38 which amplify and/or condition the signal for controlling the display 36.

Microprocessor 10 further includes a speech synthesis circuitry portion 40 which generates electrical signals representative of selected output speech phrases which phrases are generated in response primarily to audible human speech signals received at microphone 26. Alternately, the output signals from speech synthesizer 40 may be in response to the manual activation of controls or switches on the interactive clock. The speech synthesizer 40 may also provide notice when the system is approaching a malfunction threshold associated with various circuits of the interactive clock. As shown, speech synthesizer 40 provides its output signals to a sound producing device such as, for example, a speaker or speaker system 42.

In one preferred embodiment, the interactive clock of this invention will include the capability of functioning as an alarm clock. Consequently, the microprocessor 10 will further include an audible alarm generation circuitry 44 for generating, as an example only, an intermittent 400 Hz signal having an output also provided to speaker 42. In one embodiment, the audible alarm generator 44 will provide three levels of an output signal which makes sounds over selected periods of time such that if the user does not acknowledge the alarm by either hitting the snooze button or turning the alarm off, the volume output from speaker 42 will increase to at least two additional levels. In still another preferred embodiment, the audible alarm generator 44 will interact with the clocking circuit 34 and include additional circuitry for providing at least two separate alarms which can occur at different selected times. Thus, there is also shown a switch circuit 46 for selecting alarm 1, alarm 2, or both alarms 1 and 2. Switch 46 will also include an "off" position for disabling the alarm. It will be appreciated that there is also included a "snooze" button 48 connected to the microprocessor 10 for interrupting the audible alarm from speaker 42 produced by audible alarm generator 44 for a short selected period of time in a manner well recognized by those skilled in the art. Preferably, the snooze button 48 may be activated up to a selected number of times, such as three, so that the user may avoid falling back into a deep sleep.

Activation of the "snooze" button 48 at times other than to interrupt the alarm, is recognized by the interactive clock radio system of this invention as a signal to initiate a "training routine" or a routine to set the time of day or the "wake-up" times for the two alarms. The use of the "snooze" button 48 for this purpose is for convenience only and it will certainly be understood that other buttons and switches could be used to initiate the training and/or time set routines.

Also shown electrically connected to microprocessor 10, is a memory 50 which in one embodiment may be an EEPROM (electrically erasable programmable read-only memory) and is used for storing at least some speaker dependent data required by the microprocessor to determine if at least a part of the received audible human speech represents at least one of a number of predetermined input speech phrases. Although shown as a memory unit separate from microprocessor 10, it will be appreciated that additional memory may be integral to the microprocessor 10 and may include data for recognizing specific speech phrases which data may not be speaker dependent. It is also possible, of course, that all of the recognition data could be stored in the memory 50.

A second memory 52 is a ROM (read-only memory) which stores data required by the microprocessor 10 to synthesize specific output phrases upon demand. As was the case with the memory 50, memory 52 may also be an integral part of the microprocessor or may be a separate memory unit as shown in FIG. 1.

There is also included a standard 115VAC outlet unit 53 which is connected directly to the 115VAC line power. Outlet unit 53 is also connected to light control circuitry 55 in microprocessor 10. Outlet unit 53 includes electrical circuitry responsive to control signals from light control circuitry 55 for switching power "ON" and "OFF" to the plug 57 and to vary the percentage of each half of the AC input sine wave power applied to plug 57. A standard light unit 59 having a plug 61 is connected to the plug 59 of outlet unit 53 so as to be turned "ON" and "OFF" and the light level set in response to the control signals from light control circuitry 55. Thus, the level of light can be set to gradually decrease the "OFF" over a selected power of time in a go-to-sleep mode. Alternately, the light can operate in conjunction with an alarm "ON" signal so as to gradually increase to a maximum over a selected period of time. The use of a triac circuit for these purposes is well recognized in the art. For example, refer to U.S. Pat. No. 5,008,865 issued to Shaffer et al. There are, of course, many other types of electronic circuits available using triacs for turning lights on and off and for controlling the brightness level.

Figure 2A:
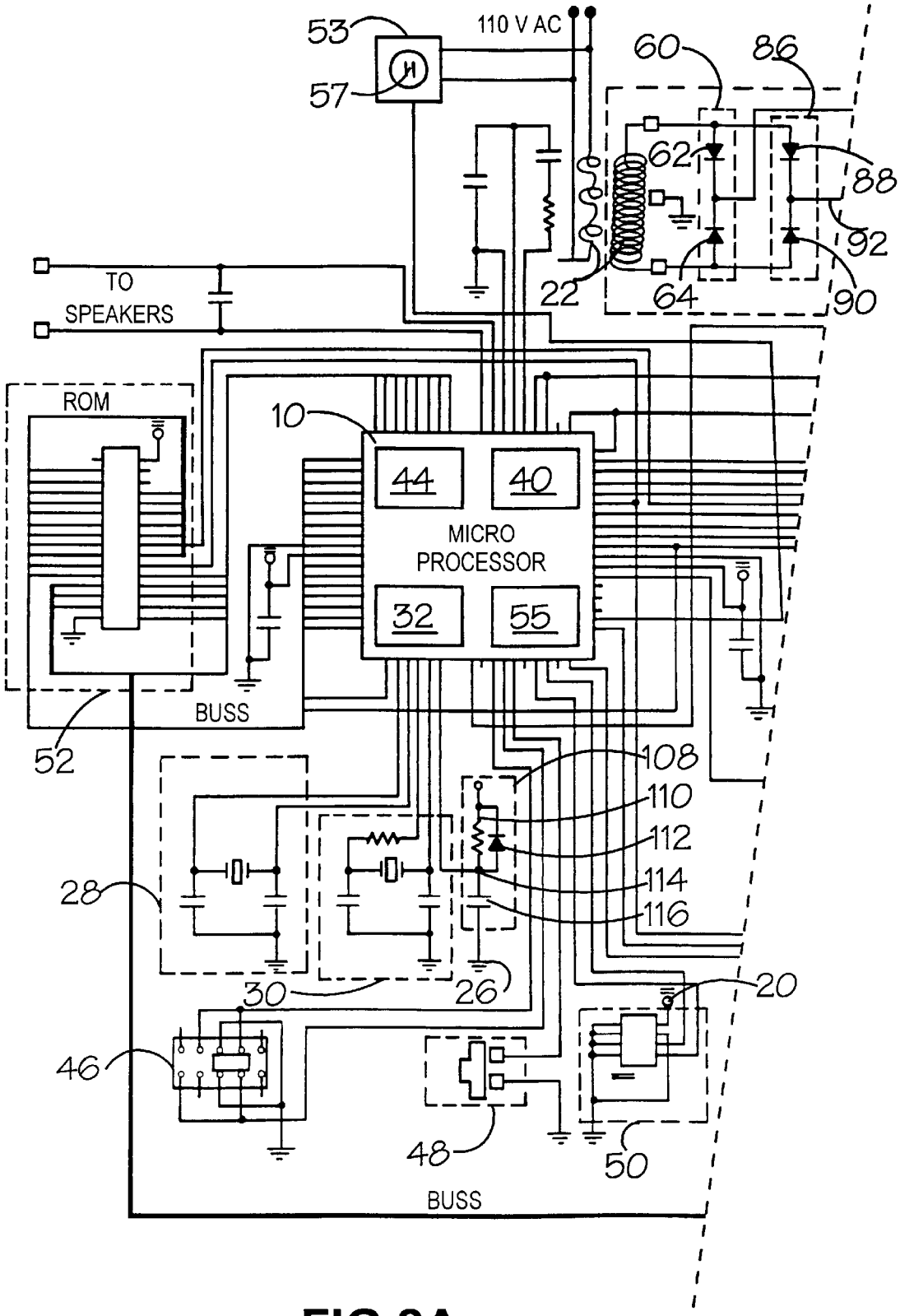
FIG. 2 is an electrical schematic of the embodiment of FIG. 1.
Figure 2B:
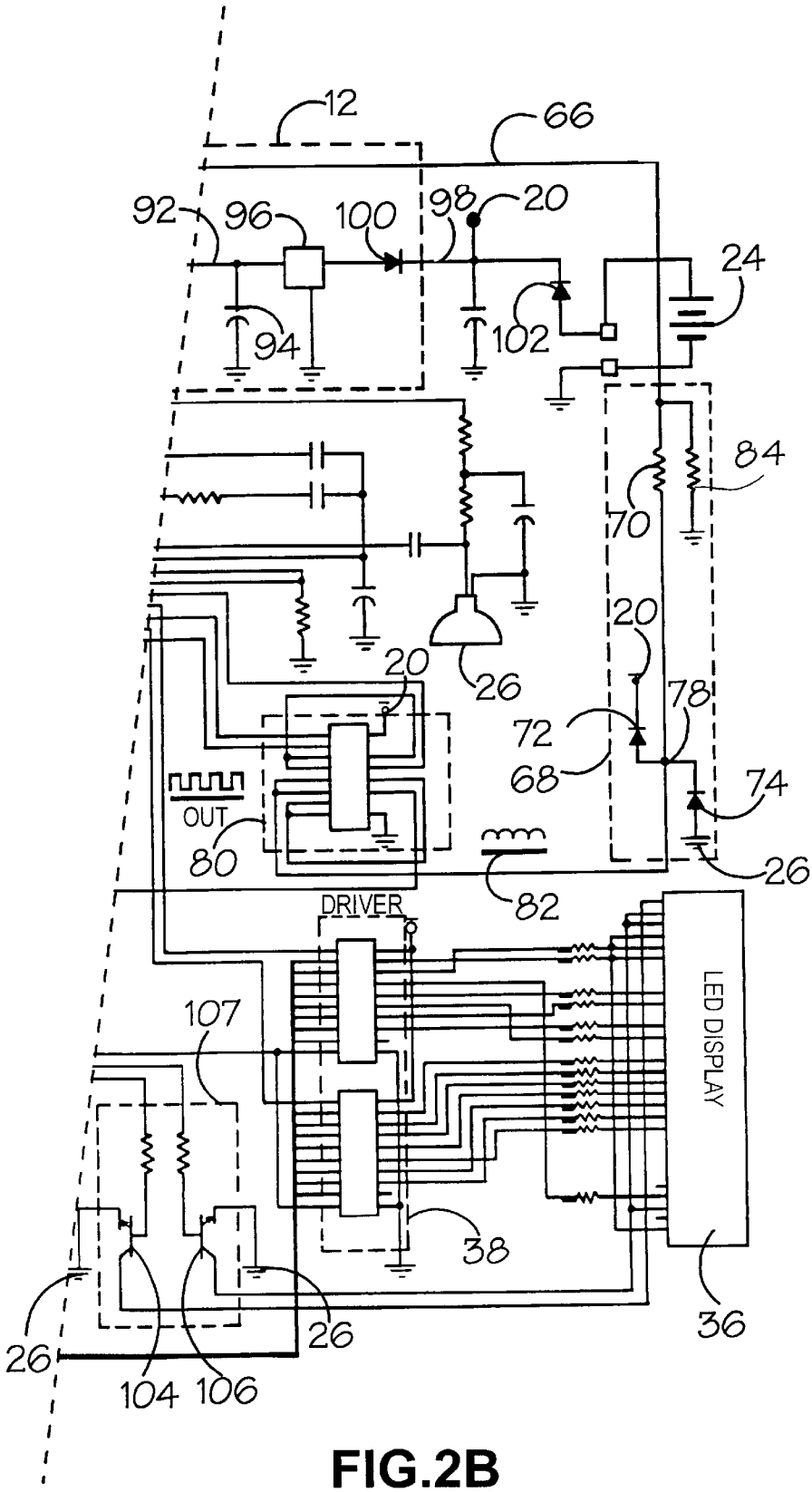

Referring now to FIG. 2, there is shown an electrical schematic of the embodiment of FIG. 1. As shown, common elements of circuitry discussed in FIG. 1 bear the same reference numbers in the schematic of FIG. 2. Some of the components of the elements discussed in FIG. 1 are further discussed with respect to FIG. 2 and the figure also includes a few elements not mentioned in the block diagram. As shown, the power supply 12 illustrated in this schematic is shown with only the low side of transformer 22 being illustrated. As shown, the output of transformer 22 is provided to a first rectifier or rectifying circuitry 60 which includes a pair of diodes 62 and 64. The rectified sine wave output of rectifier 60 on line 66 is provided to a voltage clamping circuit 68 which includes a current-limiting resistor 70 and a pair of diodes 72 and 74. The cathode of diode 72 is connected to the power bus 20 and the anode of diode 74 is connected to ground 26. The node 78 is between the anode of diode 72 and the cathode of diode 74 and provides a clamped rectified sine wave signal to circuitry 80 by line 82 which circuitry 80 then provides a square wave output at 120 Hz. The 120 Hz square wave is then provided to the microprocessor 10 and to the memory circuit 52. The two outputs of the circuitry 80 may be produced by any suitable technique. However, a particularly suitable circuit comprises four "Nand" gates, two for each output and which act as a schmidtt trigger. There is also included a resistor 84 connected to line 66 which assures a positive voltage is always maintained at line 66. In the event there is a loss of line power and consequently a loss of the 120 Hz square wave pulse train to the microprocessor in the ROM 52, the microprocessor switches to the watch crystal circuitry oscillator 30 for its pulse train. At this time, the oscillator 28 will also be disabled.

The main power bus 20 is provided by a second rectifying circuitry 86 which includes, for example, a pair of rectifying diodes 88 and 90. The rectified sine wave output of rectifying circuitry 86 on line 92 is filtered by capacitor 94 and provided to a 6 volt voltage regulator 96 having an output on line 98 to blocking diode 100. As will be discussed later, blocking diode 100 prevents backup power from battery 24 from being routed through the rectifying circuit which would result in the battery being rapidly discharged. The 6 volt regulator 96 may typically be chosen to be Item No. LM78LO6 regulator manufactured by the Fairchild Semiconductor company. As shown, blocking diode 100 is connected with its anode to the regulator and its cathode to power bus 20. Also as shown battery 24 is connected to power bus 20 through a second blocking diode 102 so as to provide backup power to power bus 20. Blocking diode 102 prevents battery 24 from receiving a charging voltage which may tend to overheat and cause damage to the battery and the circuitry. It will be appreciated, however, by those skilled in the art, if battery 24 is chosen to be a rechargeable NiCad (Nickel Cadmium) battery, diode 102 may be eliminated.

ROM 52, as shown in the schematic of FIG. 2, is selected as a one meg. read-only memory (i.e., 128 k×8). The EEPROM 50 is a serial EEPROM that has a 32 k byte by 8 structure.

The two NPN bipolar transistors 104 and 106 of the cathode circuitry 107 alternately provide a ground 26 for the two separate ground inputs for the two cathode terminals of a standard duplex clock digital display. Such a duplex clock display is well known by those skilled in the art and will not be discussed further. The circuitry of FIG. 2 also includes reset circuitry 108 comprised of a resistor 110 and a diode 112 connected in parallel between power bus 20 and a node 114. A capacitor 116 is connected between node 114 and ground 26. The circuitry provides a reset signal from node 114 to microprocessor 10 in the event of a power failure and a subsequent reapplication of power.

Figure 3:
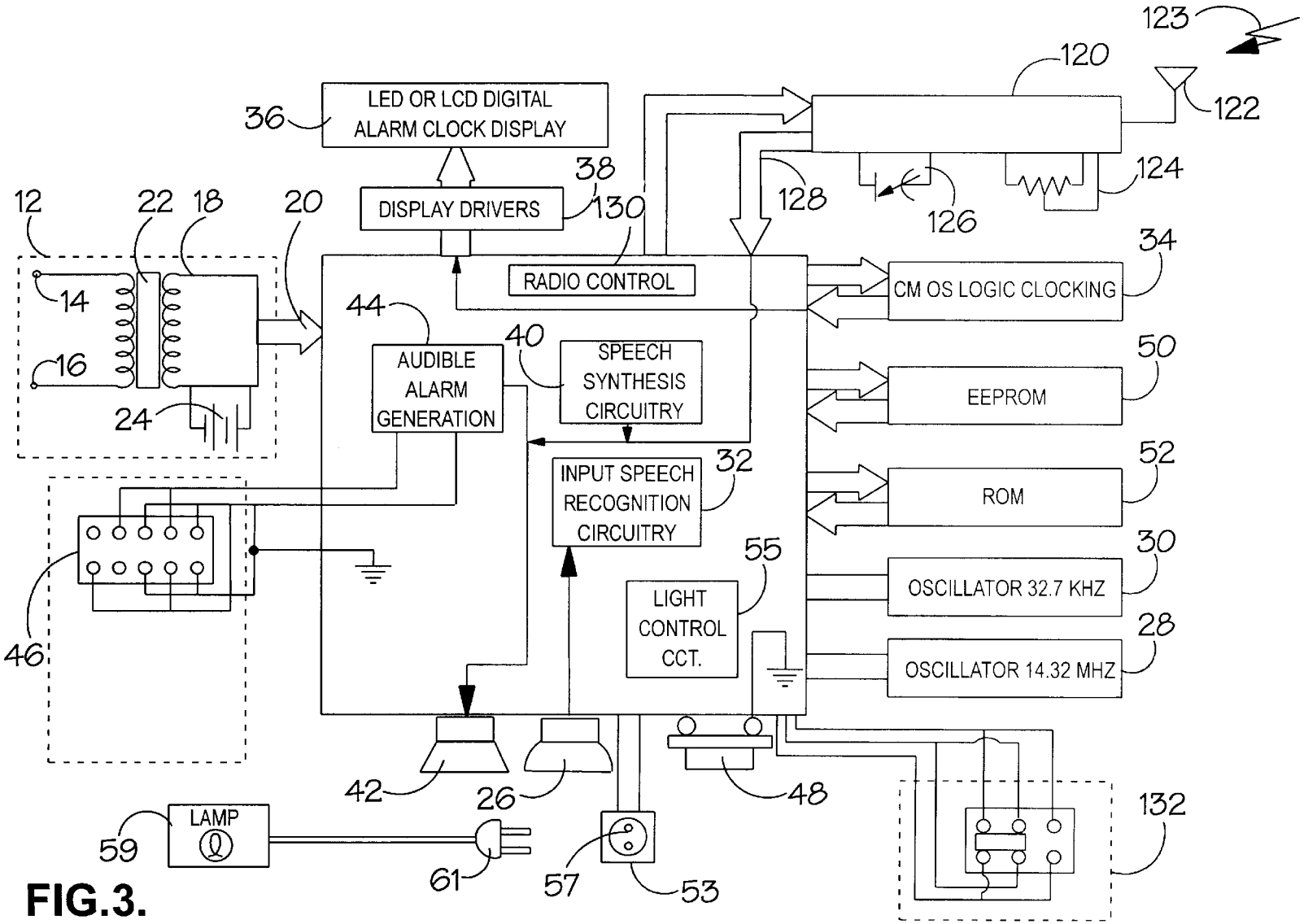
FIG. 3 is a block diagram of an interactive clock radio incorporating the teachings of the present invention.

Referring now to FIG. 3, there is shown a block diagram of an interactive voice recognition digital alarm clock radio. Most of the circuitry shown in FIG. 3 is substantially the same as that shown in FIG. 1 and like elements carry like reference numbers. However, in addition to the circuitry and items shown in FIG. 1, there is also included a digital radio receiver 120 having an antenna 122 for receiving radio waves 123, a standard volume control 124 and means for manual tuning 126. The digital radio receiver 120 may be an AM receiver, an FM receiver, or both and AM and FM receiver. The audio output electrical signals from receiver 120 on line 128 are provided to the microprocessor 10 and eventually provided to the speaker 42. Microprocessor 10, in addition to its input speech circuitry 32, its speech synthesis circuitry 40 and its audio alarm generator circuitry 44, also includes radio control signal circuitry 130 for providing digital control signals to the digital radio receiver 120 for turning the radio on and off, tuning to selected stations, and the like. The radio control signal circuitry is responsive to selected one of the predetermined speech phrases generated by speech synthesis circuitry 40. As shown, the circuits of FIG. 3 further includes wake-up selection circuitry 132 for providing signals to microprocessor 10 which then controls whether the audible alarm generator 44 produces signals to speaker 42 and/or whether or not the radio receiver 120 provides signals to speaker 42. According to still another possible feature, the radio may come on first followed by the alarm buzzer if the user does not acknowledge he or she is awake after a selected period of time.

Finally, microprocessor 10 also includes circuitry used for training the voice recognition portion of the device to be receptive to one or more specific human voices. Although some of the predetermined speech phrases to be recognized may be independent of the particular individual speaking the phrase (i.e., speaker independent), preferably the circuitry is "trained" by the voices of one or two users so as to recognize the commands, and thus are "speaker dependent." Although the training circuitry requires memory, the memory requirements are not nearly as large for the training process as the memory would be if all of the predetermined speech phrases were speaker independent of accent, gender, etc. Furthermore, the recognition accuracy is substantially improved by the training process. Although other techniques for voice recognition and speech synthesis are suitable for use with the present invention, some specific effective techniques for storing data related to speaker dependent voice recognition and speech synthesis are described in U.S. Pat. No. 4,214,125 issued to Forrest S. Mozer and Richard P. Stauduhur. The techniques of U.S. Pat. No. 4,214,125 are incorporated in their entirety herein.

Figure 4A:
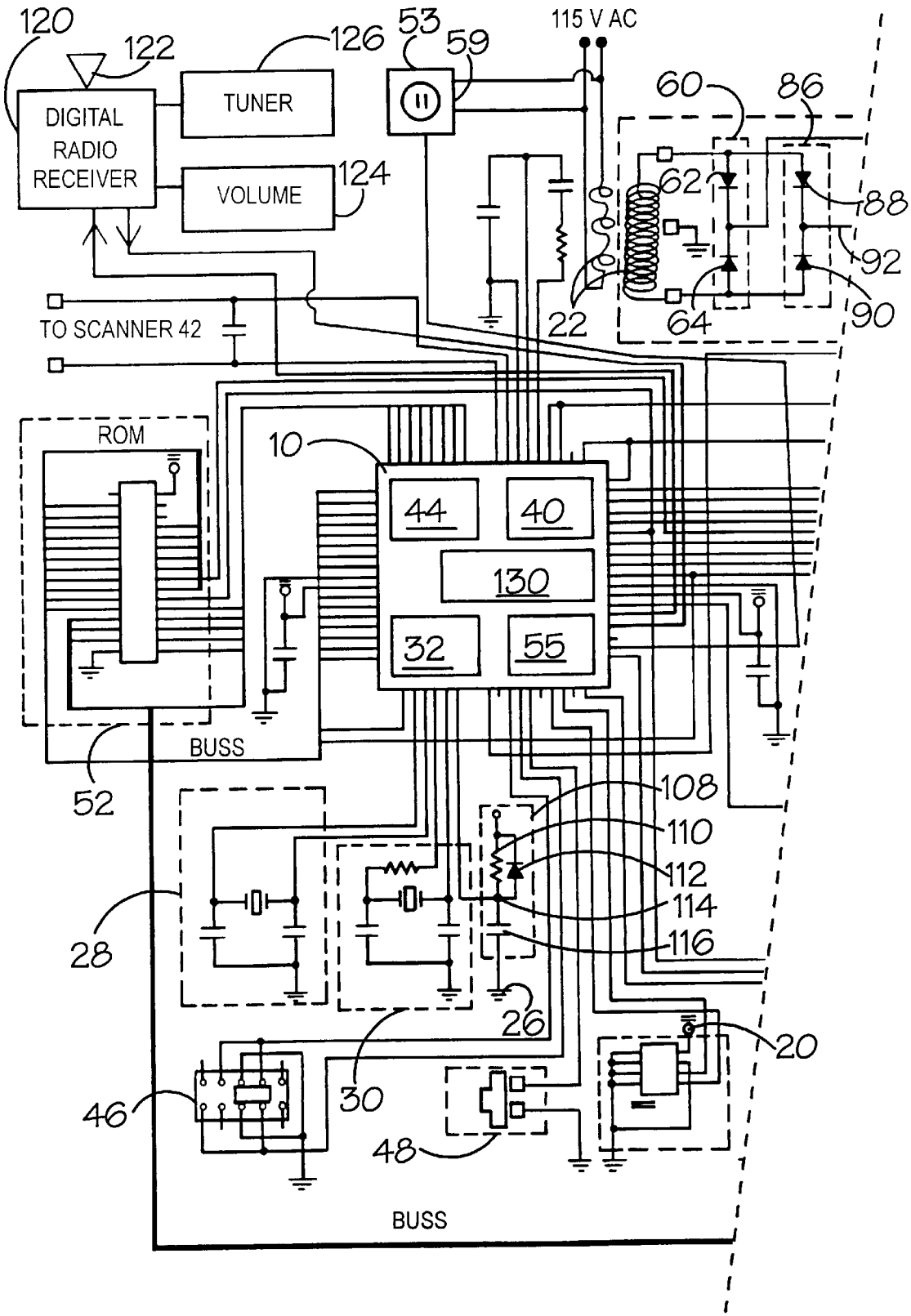
FIG. 4 is an electrical schematic of the embodiment of FIG. 3.
Figure 4B:
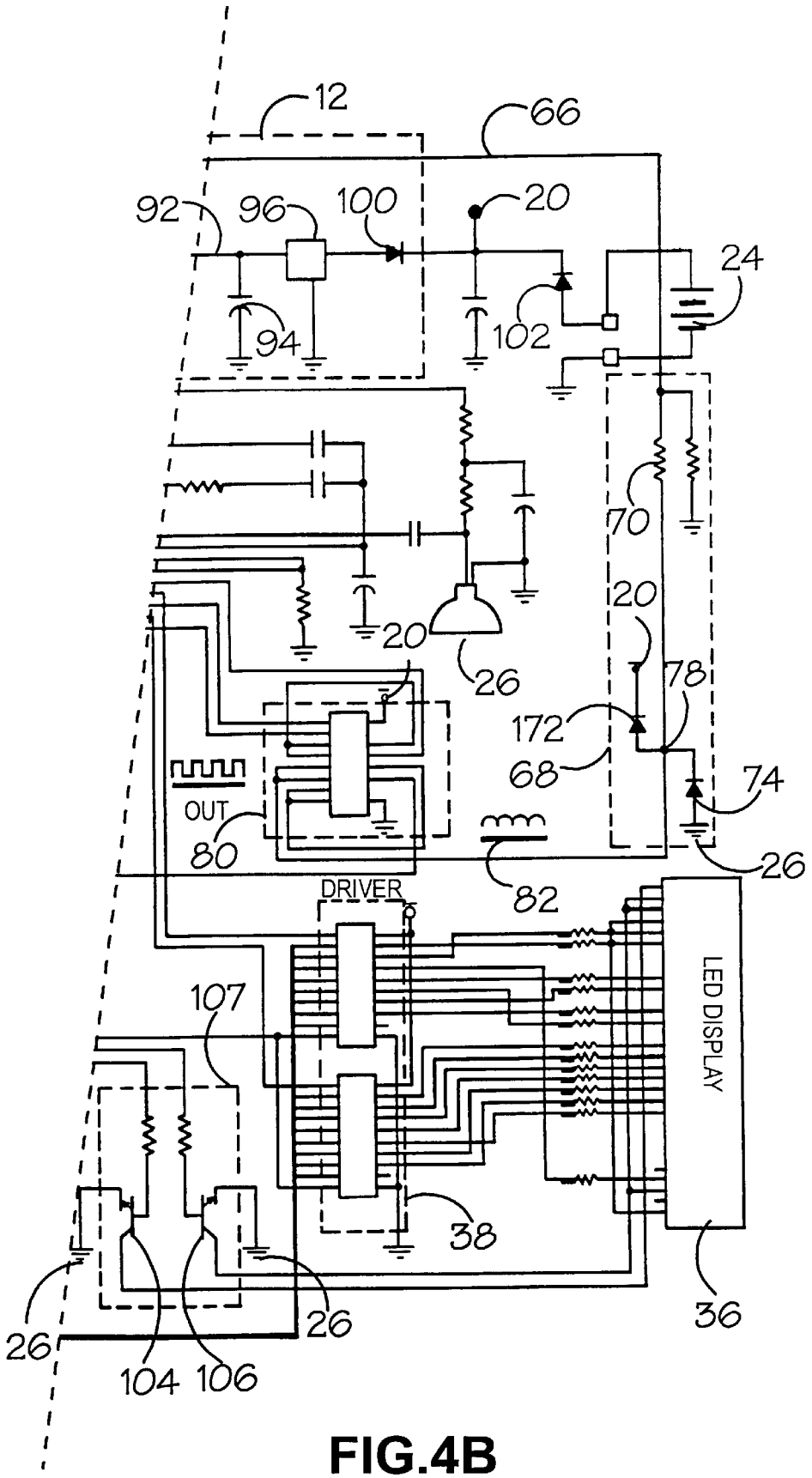

Referring to FIG. 4, there is shown the electrical schematic of the interactive voice recognition clock radio circuitry of FIG. 3. The circuitry of FIG. 4 is substantially similar to that of FIG. 2 and the only variations and added circuits are the Digital Radio Receiver 120, which includes the antenna 122, the manual volume control 124 and the manual tuning control 126. It will be appreciated that since the Radio Receiver 120 is a digital receiver, turning the radio "on" and "off," tuning to a station and setting the volume level is controlled by digital input signals provided by the radio control portion 130 of microprocessor 10. Thus, it will be appreciated that the manual volume control 124 and tuning control 126 will not typically be a potentiometer and tuning capacitor, as indicated for convenience in FIG. 3, but are digital circuits which provide the proper input digital signals.

Figure 5:
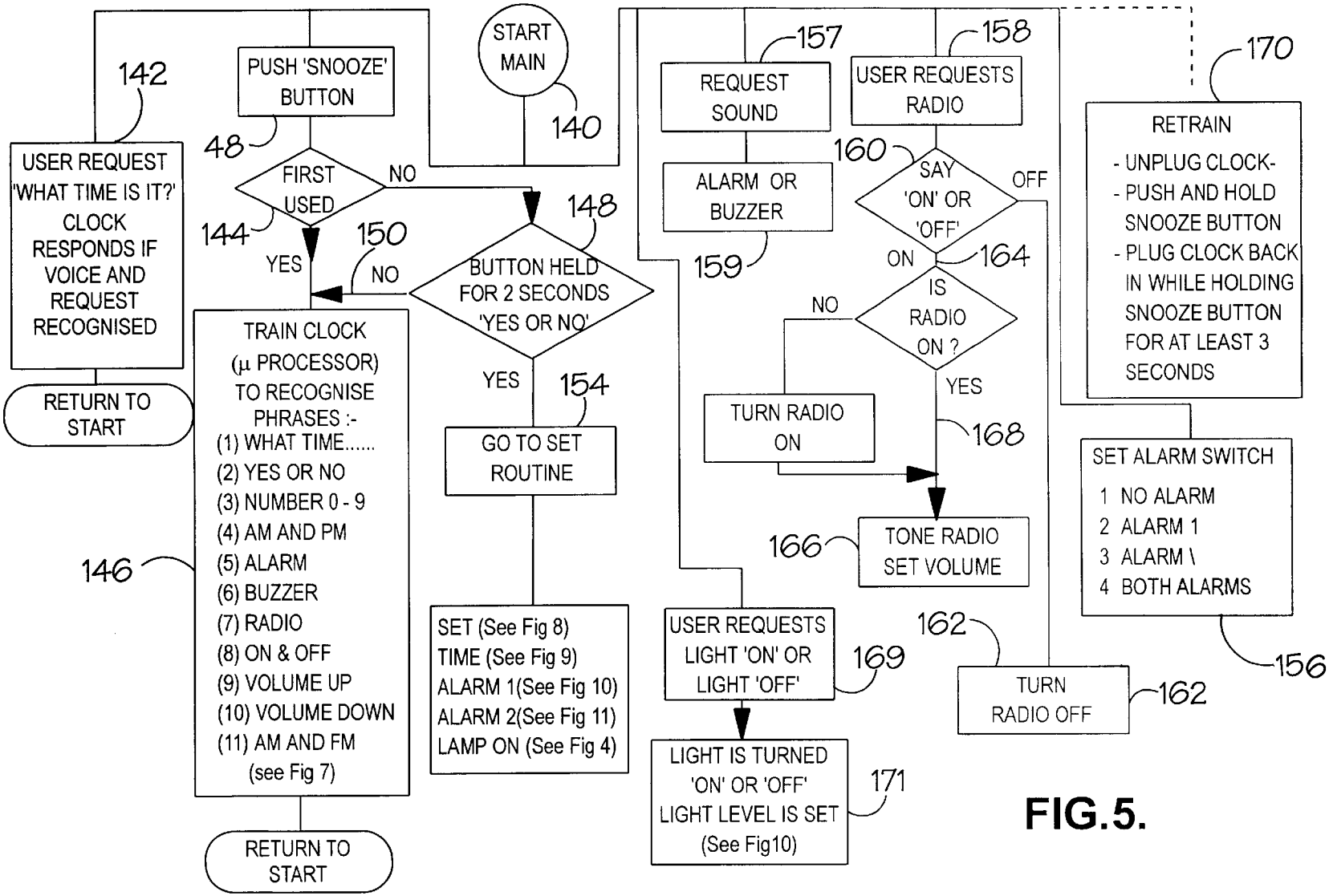
FIG. 5 is a simplified flow diagram showing a process for operating the clock radio of FIGS. 1 through 4; and FIG. 6

Referring now to FIG. 5, there is shown a simplified block diagram of the voice interaction used by the radio clock configuration of FIGS. 3 and 4. There is shown a starting block 140 from which all other activities follow. The block 142 represents the simplest of the requests and interactions and assumes that the microprocessor of the clock radio has already been "trained" to recognize the voice of a user and that the clock has been set to the proper time and the alarm functions have been selected. As shown and as will be discussed in more detail hereinafter, there is a voice request of the time such as "what time is it?" and if the clock recognizes the voice of the speaker, the clock will provide the actual time such as by stating "the time is 10:45 PM." Once the time has been stated the program will then return to the starting block 140.

However, as was stated, although it is possible that the voice interactive radio be speaker independent, such independence requires huge amounts of memory. Therefore, there is included in the invention a training program which is run by the microprocessor and which is initiated by pressing the snooze button 48 as was described with respect to FIGS. 1 and 2. If this is the first use of the clock radio after its purchase, as is indicated by the logic block 144, then the program is directed directly to the training portion 146 of the program. That is, the microprocessor computer chip will recognize that there has not been any training of the system and that the first thing that must occur at this point is the training process. However, if the answer to the query whether this is the first time the clock has been used in logic block 144 is "no," then the program branches to the logic block 148 which determines whether the button was held for two seconds or more. In the event the button was held for two seconds or more, then the program is again directed by line 150to the training program 146 as indicated. However, if the answer is "no" that is, the button was not held for two seconds, then the program is directed to the "set" portion 152 of the program as indicated by the "Go To" block 154. As will be discussed hereinafter, when the program is branched to the "set" subprogram 152, the time and the alarms will be set by the interactive voice recognition circuitry of this invention. As shown in the training block 146, the interactive clock, or more specifically the microprocessor and memory portions of the interactive clock, are trained to recognize specific words and/or phrases spoken by a specific user. The phrases that the program is trained to recognize includes a list of phrases such as the following, which examples are provided as examples only. Depending on use, etc., other words or phrases may be appropriate.

| | | |
|---|---|---|
| "What time is it?" | "Yes" and "No" | The individual numbers between 0 and 24 |
| "AM" and "PM" | "Alarm" | "Buzzer" |
| "Radio" | "On" and "Off" | "Volume Up" |
| "Volume Down" | "FM," "Weather" and "Short Wave" | "Point" |
| Optional Phrase for CALL LETTERS (e.g. PEACH, WPBS, etc.) "Light" | "Stop" | "Bright" and "Dim" |

Once the training has been completed, it will be appreciated that the clock is now capable of recognizing a voice request of the time as was requested with respect to block 142 discussed heretofore. The system is also now ready to have the clock set to the correct time, the alarms set to a wake-up time and whether they should be on or off, the radio tuned to a correct station and the volume of the radio set. For example, it will be recalled that when the output of the logic block 148 inquired whether or not the button had been held in a depressed state for two or more seconds, as discussed heretofore the decision was "no," and the program was directed to the "set" subroutine of the program as indicated by block 152. Once directed to the "set" routine of the program, the interactive clock radio will then proceed to direct the user to provide information for setting the time and the wake-up time on the alarms. It will be appreciated, of course, that all of the responses needed by the computer for setting the time on the alarms can be made up from the combination of phrases and/or words included in the list of words used to train the clock radio as is shown in block 146. Also as shown at block 156, it is necessary to "set the slide switch 46" which typically is a manual switch which is set to one of the positions of "no alarm" (or off), "alarm 1," "alarm 2," or both alarms. This is a manual technique for setting an alarm, and whether there should be two different alarms at different times. This manual process could also be accomplished during a sub-routing for setting the time and setting the alarms.

According to block 157 there is then a request that the alarm sound be set by speaking the predetermined phrase "alarm." The program is then directed to a subprogram 159 by which the alarm is selected to be the radio only, a buzzer only, or both the radio and the buzzer.

It will be appreciated, of course, that the user may wish to turn the radio on other than having it come on automatically as a wake-up device in the morning as indicated at block 158. Thus, according to the logic block at 160, the program will listen for the phrases "radio on" or "radio off." Assuming the radio is on and the "radio off" phrase is detected then, as indicated by block 162, the radio will be turned off. Of course, if the radio is already off this command would have no affect. However, if the radio is off, the voice recognition system recognizes the phrase "radio on," as indicated on line 164, then the main program branches to a subprogram 166 indicated by line 168 which turns the radio on and, if necessary, will also allow someone to tune the radio to the proper station and set the volume to the desired level.

Also, as shown, there is included an independent path 169 for turning a lamp "ON" and "OFF" and setting the brightness level. As shown, a user will request "Light On" or "Light Off" and, if the phrase "light on" is spoken, the light is turned on and the brightness level set as indicated in step 171.

It will be recalled that originally the radio was trained to recognize one or perhaps two or three specific voices. However, it will be appreciated that the radio could be sold, given away, or made available for other users other than the original two users. In this event, as indicated by block 170, there is a procedure for erasing the memory which holds the specific data recorded during the training process of the specific voices such that the radio can be retrained to new users. This process is initiated by unplugging the clock radio and then holding the snooze button 48 down while plugging in the clock radio and continue to hold the snooze button 48 down for at least three seconds. This process will affect the erasure of the memory and allow the retraining as will be discussed with respect to circuitry 170 of FIG. 12.

Figure 6:
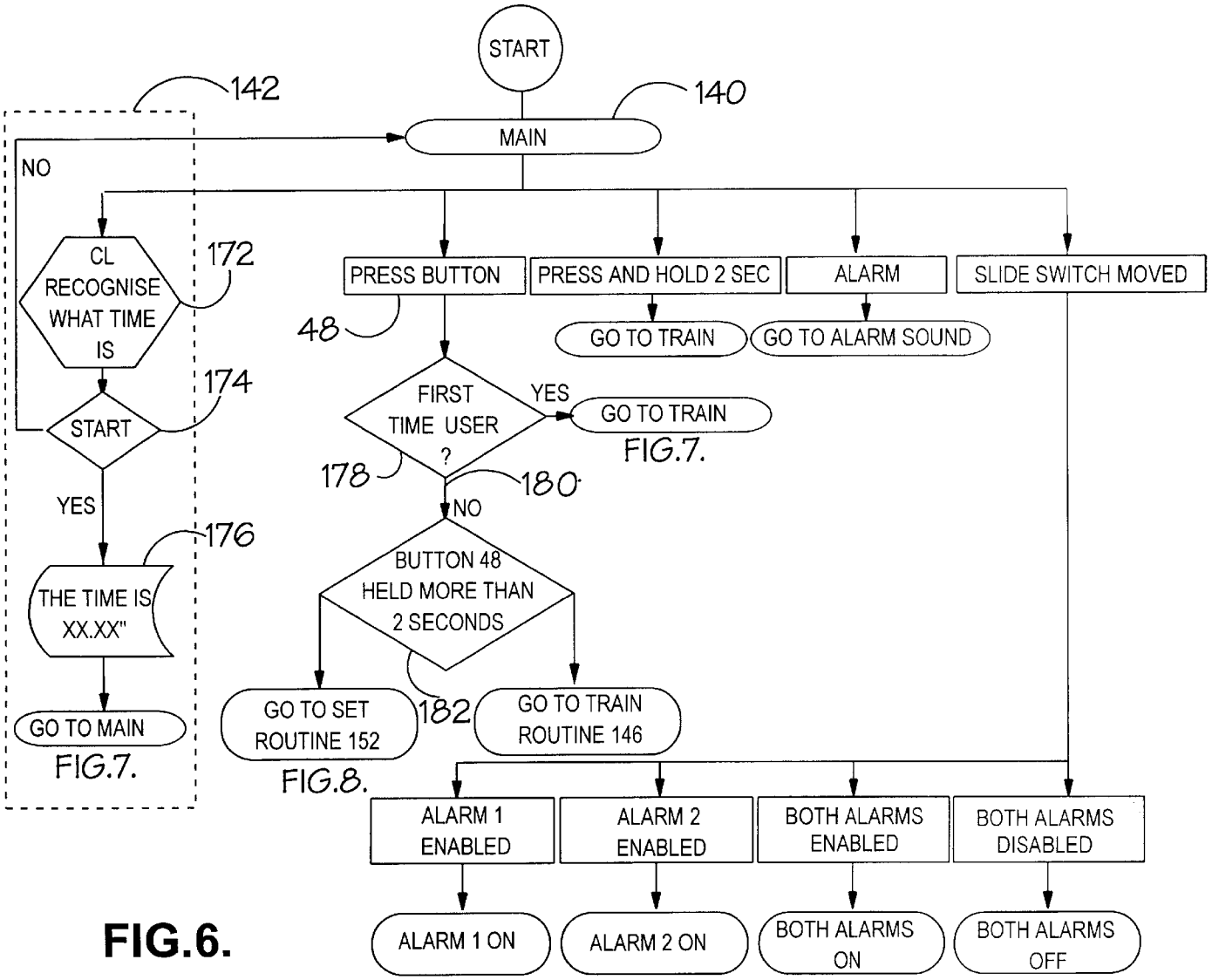

Referring now to FIGS. 6 through 12, there are shown the flow diagrams representing the operation of the microprocessor 10 and other circuitry of the invention. Some of the blocks in the following flow diagrams will be common to FIGS. 6 through 12 and the same as those used in the very simplified flow diagram of FIG. 5. As shown in the "main" routine shown in FIG. 6, there is a start location or step 140 labeled as "main" to which the program typically returns after finishing one of the subroutines so it can be redirected to other subroutines. For example, as was discussed briefly above and as shown in FIG. 6, if someone speaks the phrase "what time is it?" as indicated by block 172, the system will analyze the sound and phrase and determine if there is recognition of the phrase as shown in block 174. That is, was it spoken by someone who has trained the program to recognize that individual's voice? If there is no recognition, the program simply returns back to the main program block 140 as indicated. However, if the system recognizes the voice and the phrase "what time is it?" the computer then sees this recognition as a command and will then, using its voice speech synthesis circuit, pronounce the phrase "the time is 10:45 PM" (or whatever the time is) as indicated by block 176. The program is then directed back to the main starting point 140 as indicated. However, as was indicated, before the system can recognize a voice, it must be trained and as was discussed briefly before, if the snooze button 48 is pressed, the program immediately determines at logic block 178 if this is the first time since purchase that the clock radio has been attempted to be used. If the answer is yes, that is, it has not been trained, then the clock moves directly to the training program or routine 146. If the interactive clock radio of this invention has been trained and the answer is no as indicated by line 180, the logic circuitry of the clock radio then determines whether the snooze button 48 was held down more than two seconds as indicated by logic block 182. If the button was held down less than two seconds, then the clock program is directed to the set routine 152 shown in FIG. 8. If the button was held down two seconds or more, then the program is directed to the training routine 146 shown in FIG. 7.

Figure 7:
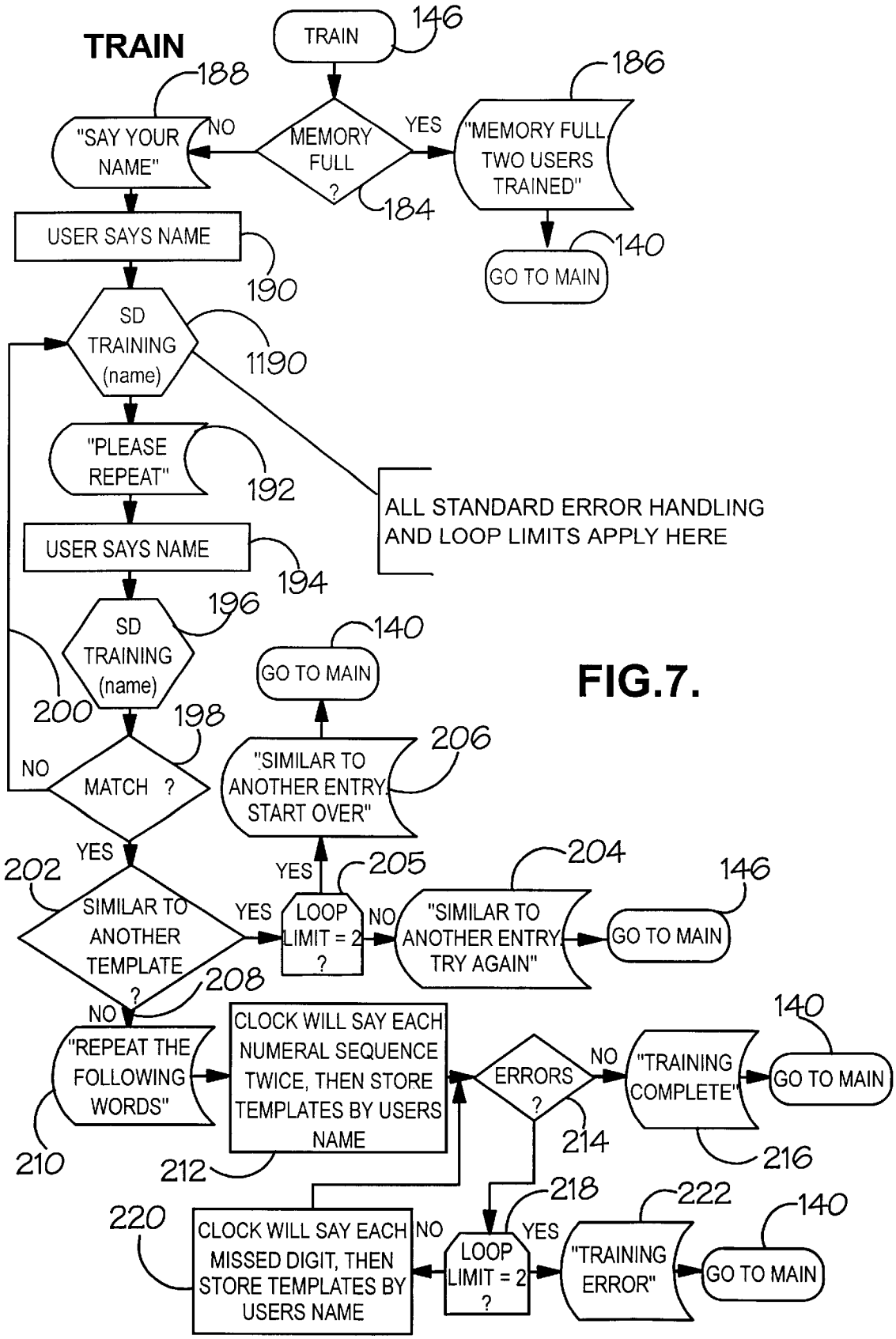
Figure 8:
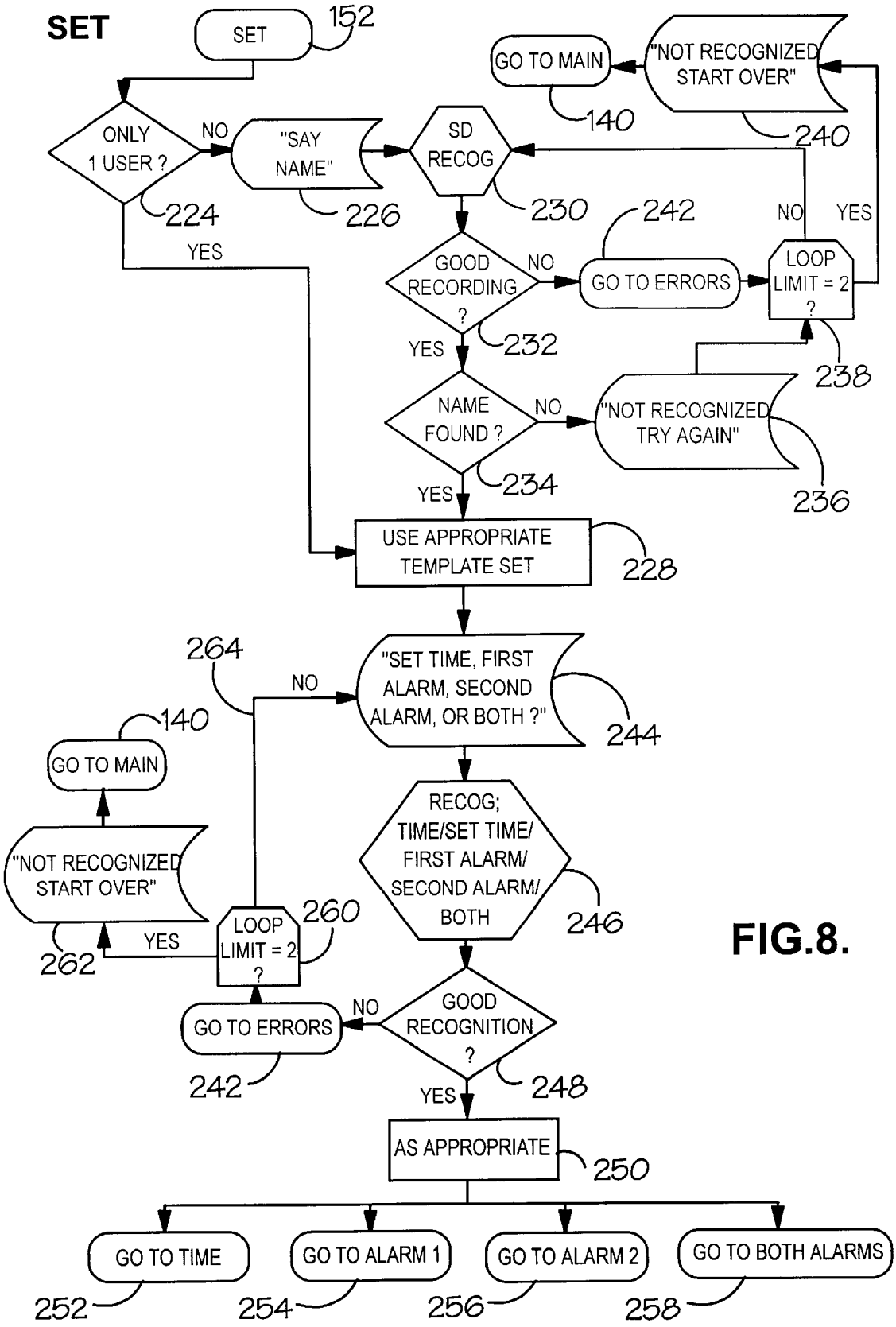

Referring now to FIG. 7, the subroutine for the training program is discussed. As shown at the starting block 146, the program progresses to a logic block 184 to determine whether two users have trained the program. In other words, is the memory full. If the answer is yes, that is, two other people have already trained the program, then the speech synthesis circuitry of the system will deliver the phrase "memory full, two users trained" as indicated by block 186 and the program will return to the main block 140. However, if the decision represented by block 184 is "no," then the computer will state the phrase "say your name" as indicated in block 188. At this point, the new user will state their name as indicated in block 190 and the computer system will receive, analyze and compress and store data related to the spoken name as indicated in block 190. Once the data has been processed and stored, the computer will then state the phrase "please repeat" as indicated by block 192. At that time the user must repeat his name substantially the same as he said it at step 190 and, as indicated at block 194, the computer will again analyze, compress and store data related to the speaker's name at step 196. The computer system or program will then progress to a logic block 198 and determine whether the two spoken versions of the name match within accepted limitations. If the two spoken names do not match sufficiently, then as indicated by the return line 200, the program starts over and the user must again say their name as indicated in block 188. However, if there is a match (i.e., the speaker's name was substantially the same) the computer will evaluate the user's name as indicated at logic block 202 and determine whether or not the name is similar or has similar characteristics to a template or name already existing. Of course, if there has been no other user or previous training, the answer would be no. However, in the event there are some similarities, the answer is yes then the computer will do further analysis and evaluations to determine if the similarities are too similar or not substantially similar to the other entry. For example, perhaps the two users have the names "Carol" and "Carolyn." In such an event, the voice recognition could have difficulty. If the limitations are substantially the same, the computer will first state the phrase "Similar to another entry. Try again." as indicated in block 204 and the program will be directed back to the start of the training program at block 146 and loop limit or counter 205 will increment to "1" (one). On the second try, if the detailed analysis determines that the similarities are still excessive, loop counter 205 will increment and be at its maximum of "2" and direct the program to state the phrase "Similar to another entry. Start over." as indicated in block 206 and the program will then be directed back to the start of the main program block 140. At this point, the user should consider using another version of his or her name.

However, in most cases, the output of the logic block 202 will be "no" as indicated on line 208. That is, the spoken word or name is not similar or too similar to another template or speaker and the speech synthesis circuitry of the computer will, as indicated at step 210, state the phrase "repeat the following words." The words include those indicated in block 146 and as were discussed heretofore. The speech synthesis circuitry will then state each of the words and/or phrases as was discussed in FIG. 5 such as "what time is it?", "yes," "no," all of the numbers between 0 and 24 (i.e., zero, one, two . . . twenty-four), etc., etc. as shown at block 212. After the computer has stated each word or phrase once, the user will repeat the phrase or number at which time the information will be stored by the user's name template and the speech synthesis of the computer will again repeat the word which is to be followed again by the user repeating the word and again the user's words will be stored by user's template as is also indicated in block 212. This process will be repeated for all of the words and numbers as was discussed above after which the program progresses to a logic element 214 to determine if there were errors in the training process. That is, was each of the versions of the words spoken twice within a satisfactory limit. If there were no errors, then the computer will state "training complete" as indicated by block 216 and the program will be redirected back to the main block 140. On the other hand, if there were errors, the computer is directed to loop limit evaluation block 218 to determine if the error existed for two tries and thereby exceeded acceptable limits as indicated in loop limit block 218. If the answer is no, that is the error was not greater than the set limit, then the computer will advance to block 220 where the words or digits which were not sufficiently close in content will be repeated again by the computer and the user will again say the words to get a match. However, if the analysis of block 218 determines after a predetermined number of attempts that some errors still exist, then the speech synthesis of the computer will state "training error" as indicated in block 222 and the program will be directed back to the main program start at 140. If the training error occurs, the user must decide whether to repeat the training process since he is starting over.

Once the training of the system is complete, it will be necessary to set the time of day and the alarm at a desired wake-up time. Therefore, referring now to FIG. 8, the process for setting the clock's time will be discussed. Once the process has moved to the set routine program as indicated in block 152, the program logic will determine at logic block 224 if only one user has trained the system. If the answer is no, that is two users have trained the system, the speech synthesis will state the phrase "say name" as indicated in block 226. If the answer is yes, there will be only one template set to use with respect to words and phrases trained into the program so the program will advance to the block 228 which will pick the only set of templates available. However, in the event the answer was no and the name is stated at block 226, the computer will analyze the spoken name as indicated in block 230 and then determine whether the recording is sufficient to continue as indicated in the "good recording" logic block 232. If the recording is a good recording as indicated by the yes output of logic block 232, the computer advances to another logic block 234 to determine if the spoken name is a match with one of the other names recorded. If so, the program advances again to block 228 and the appropriate template set is used for further operation. However, if no name is found that matches and the output of "name found" block 234 is no, then the computer will state the phrase "Not recognized. Try Again" as indicated at step 236. The computer will then advance to a loop limit and logic determination block 238, that is, is this the second time that the name has been spoken as indicated in block 238 and not recognized. If the answer is yes, the program then makes the statement "Not recognized. Start Over" as shown in block 240 and returns the program to the main starting point 140. However, if the answer is no, the program loops again to the recognition block 230 to determine a good recording. There is a similar loop to evaluate errors as indicated at the "no" output of block 232 which sends the program to the go-to block 240 for evaluating errors. After the error evaluation is complete, the errors subroutine returns the program to the loop limit decision block 238 to determine if this process has been repeated at least twice. If "no," the program returns to the recognition block 230 and if yes, the program goes to the statement "Not recognized. Start Over" block 242 as discussed above. However, assuming that the name was found and the appropriate template set has been set, the program then makes the statement "set time, first alarm, second alarm or both" as indicated by statement block 244. The user then proceeds to speak one of the appropriate phrases "time, set time, first alarm, second alarm, or both" one phrase at a time as indicated in block 246. If the individual phrases are recognized as indicated by logic block 248, the program then advances to the next appropriate subroutine as indicated by block 250 such as the go to time routine 252, go to alarm 1 (block 254), go to alarm 2 (block 256) or go to both alarms (block 258). However, if there is no good recognition the program is again directed to the errors subroutine 242. Once the errors have been evaluated, the loop limit decision block 260 then determines if this is the second time errors have occurred in this process. If the answer is yes, the speech synthesis will state "Not recognized. Start Over" as indicated in block 262. At that point, the program will be directed to back to the starting point of the main program block 140. If the limit of two has not been passed then the program is directed back to the "set time first" statement 244 as indicated by the "no" line 264.

Figure 9:
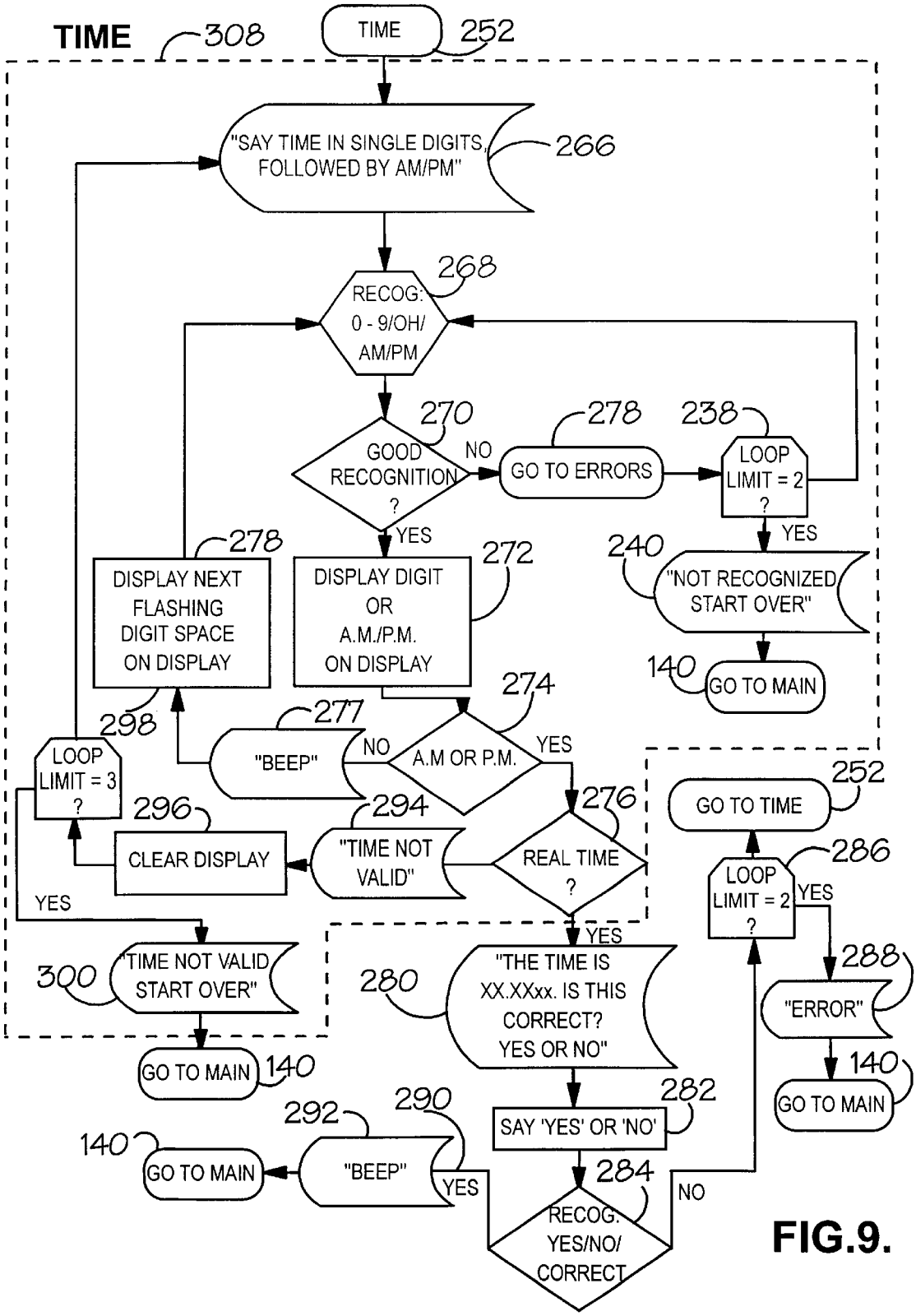

Referring now to FIG. 9, the subroutine 252 for setting the time of day will be discussed. Although it will be appreciated the clock could be designed to use a 24 hour clock and the terms AM and PM would not be necessary, since the preferred usage in the United States is to use AM and PM with a 12 hour clock, that version of setting time will be discussed. It will be appreciated, of course, by those skilled in the art that setting the time for a 24 hour clock is substantially similar but somewhat simpler. Therefore, once the time routine has been entered at block 252, the program progresses to block 266 and the speech synthesis makes the statement "Say time in single digits followed by AM or PM." The computer then receives these sounds and determines whether they recognize any of the numbers 0 through 9, oh, or AM or PM as indicated in block 268. If there is good recognition as indicated in block 270, the digital display 36 shown in FIGS. 1, 2, 3 and 4, will provide a one digit display or one of the terms AM or PM as appropriate and as indicated in block 272. If the decision of block 274, whether or not it is AM or PM, is no, that is, the output was a digit not one of the words "AM or PM," then, the computer progresses to block 276 and makes a "beep" sound. The display 36 will then flash the location of the next digit to be entered in the clock as indicated by block 278. The program then returns to block 266 for setting a second digit as indicated in block 266 and the process is repeated until all four digits of the clock display are complete. After the four digits phrases are complete, the speaker will then speak the phrase either AM or PM which, once recognized as indicated in block 270, will be displayed in the digital display as indicated in block 272. Logic block 274 upon receiving this output will then provide a "yes" output from block 274 to the decision block 276. Referring back to the good recognition block 270, there is another errors loop 278 similar to that discussed with the errors loop on FIG. 8 as indicated by the similar block indications 238 and 240. Referring again to the logic block 276, the computer determines whether or not the stated time is a "real time." That is, are the hours between 1 and 12 and are the minutes between 1 and 60. It will be appreciated of course, if the clock were to be running as a 24 hour clock, the computer would determine whether or not the hours are between 1 and 24. If the answer is yes, that is it is a real time, then the speech synthesis will make the statement, "The time is 10:45 PM" or any other time entered by the user, with the following statement "Is this correct? Yes or No." This series of statements is shown in block 280. The user then must provide the word "yes" or "no" as indicated in block 282. The computer then receives the statement made by the user and determines if it can recognize the phrase "yes" or the phrase "no" as indicated in block 284. If the computer recognizes the word "no" then the program is provided to the loop limit block 286 to determine if this is the second time an incorrect time has been entered. If this is not the second time then the programmer turns to the top of the clock routine at block 252 to restart. If this is the second time an improper time has been entered, the speech synthesis will make the statement "error" as indicated in block 288 and the program will then be directed back to the main starting point block 140. However, if at logic block 284 the computer recognizes the word "yes" as indicated by output 290, a beeping sound will be made indicated in block 292 and the computer program will be directed back to the main starting point 140. If this has occurred, the time has been set and the clock will be running. Referring back to block 276, if the real time logic block has determined that the spoken time was not a valid time, that is, was not between the range of 12:00 and 11:59, then the program will make the statement "time not valid" as indicated in block 294, the display will be cleared as indicated in block 296 and the program will then progress to a loop limit check set for three as indicated in block 298. If this is only the first or second time that the display has been cleared and the time has not been found valid then the speech synthesis states "Time not valid. Start over" as indicated in block 300. At this point, the computer will return to the main menu 140. However, if the display has not been cleared three times, then the computer will return to the starting block 266 for another attempt.

Figure 10:
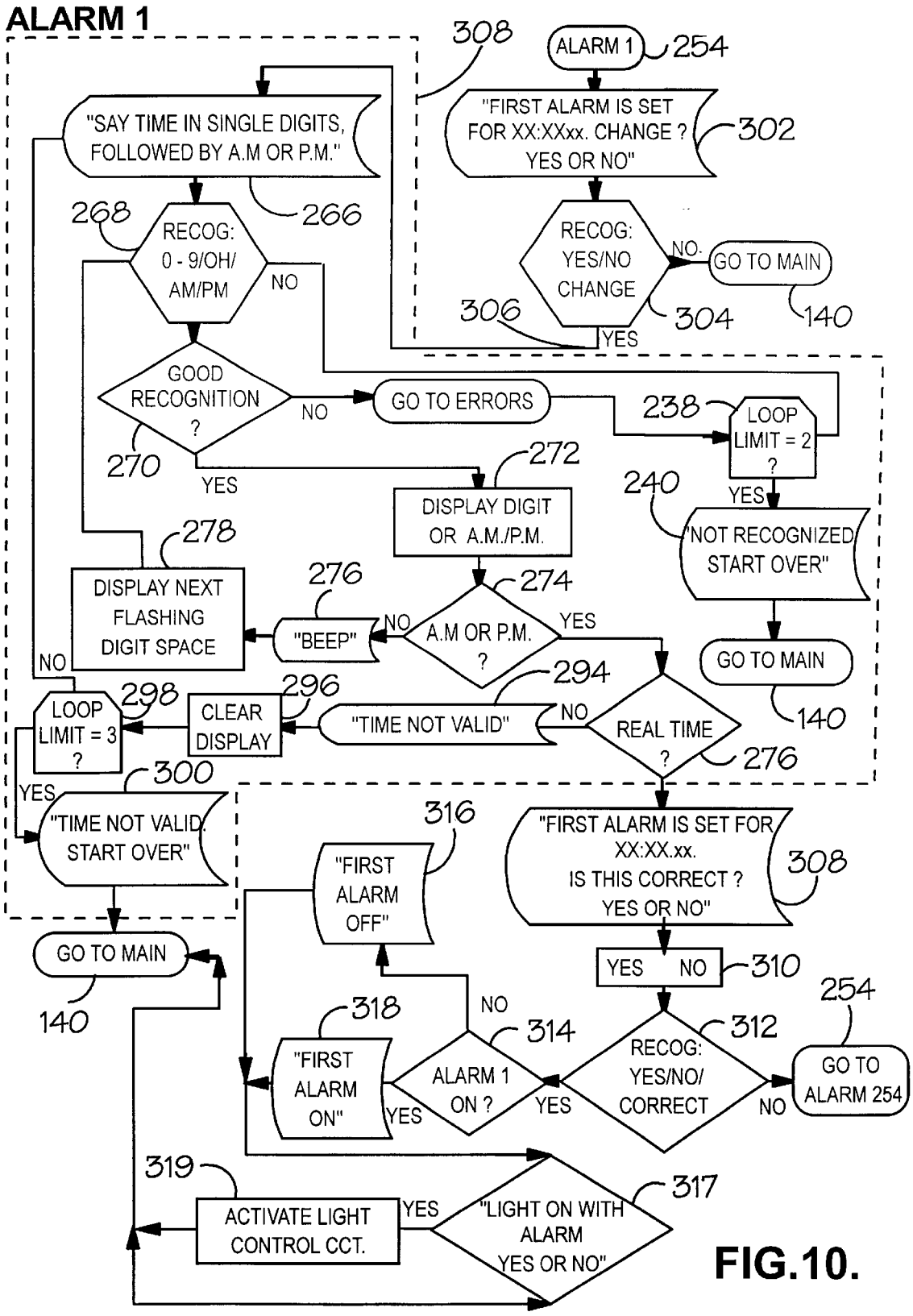

Referring again to FIG. 8, the circuitry for setting the alarms will be discussed. It will be recalled that the speaker may set either the time or the alarms or both alarms as indicated in blocks 252, 254, 256 and 258. If the user has decided to set the alarm 1, as indicated in block 254 and shown in FIG. 10, the computer program will make the following statement, "First alarm is set for 8:10 AM (or some other chosen time). Change? Yes or No" as shown in step 302. The 8:10 AM will indicate a previously set alarm time or if this is the initial setting, will likely indicate all zeros. This is indicated in block 302. The computer will then evaluate the response of the user to see if it recognizes a yes or no response shown in step 304. If the response is no, then the program will be directed back to the start of the main program block 140. That is, there is no desire to change the first alarm setting so no further action is required. However, if the response is a yes and is recognized by block 304 and shown in line 306, then the program will advance to the time setting portion of the program 308 which is the same as the time setting portion in FIG. 5. Consequently, the reference numerals on the blocks are also the same and since the operation is the same, this portion will not be discussed again. However, if the output of the real time block 276 in FIG. 10 is a yes, then, unlike the statement made by the time setting portion in FIG. 9, the speech synthesis portion of the computer program will make the statement, "First alarm is set for 8:10 AM. Is this correct? Yes or No" as indicated in block 308. The speaker or user will then make the statement "yes" or "no" as indicated in block 310 which phrase will be evaluated by the voice recognition portion of the computer (step 312) and if the circuitry recognizes that the speaker has spoken the word no then the subroutine will be directed back to the start of the program at start block 254. However, if the recognition block 312 determines that the response was a "yes" the program advances to another logic decision block 314 to determine whether the first alarm is on or off. If the first alarm is off, then the computer will make the statement "First alarm off" as indicated in block 316 and the program will then be directed to light control logic block 317 which responds to a spoken "yes" or "no." If the spoken response is "no," the program will proceed back to the main start block 140 of the main program. If the computer determines that the switch 46 of FIGS. 1, 2, 3 and 4 is set for the first alarm to be on, then the speech synthesis circuitry of the system will state "First alarm on" as indicated in block 318 and then be directed to the light control logic block 317.

Light control logic block 317 determines whether the user wants the light or lamp 59 to come on with the alarm and start gradual increase in brightness. If the output is a "no," the program proceeds to the main program start point 140. If the output is a "yes," the light control circuitry is activated as indicated by action block 319 so as to turn on the light and gradually increases its brightness. The program then proceeds to the main start point 140.

Figure 11:
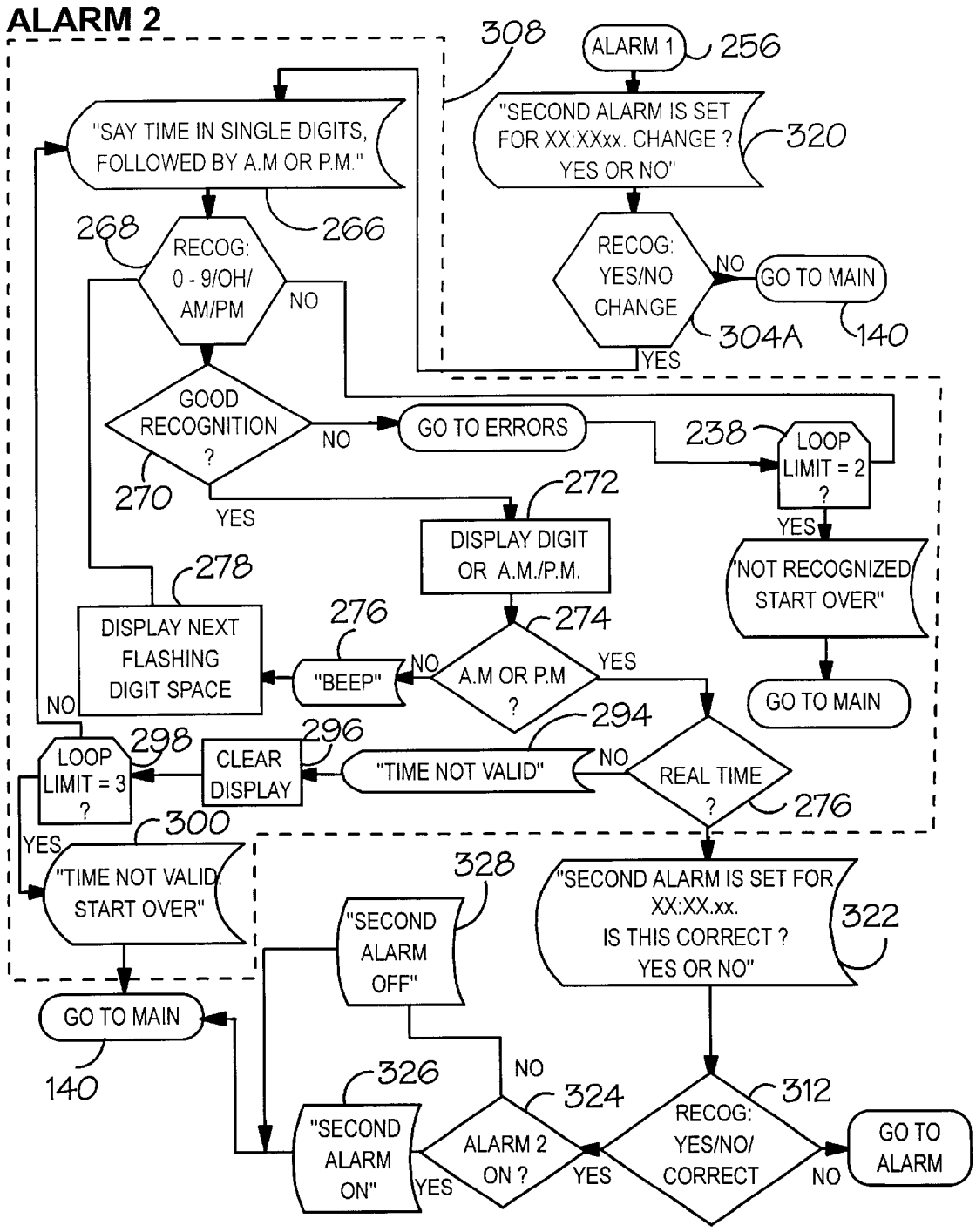

Referring now to FIG. 11, there is shown the subroutine for setting alarm 2. It will be appreciated that the process for setting alarm 2 is exactly the same as that used for setting alarm 1. The only difference being with respect to statements made by the speech synthesis portion of the system where the second alarm is identified rather than the first alarm. Blocks 320, 322, 324, 326 and 328 represent these differences. In addition, the "light control" branch logic 317 is not included with alarm 2 but, as will be appreciated, could be included just as it was with alarm 1.

Figure 12:
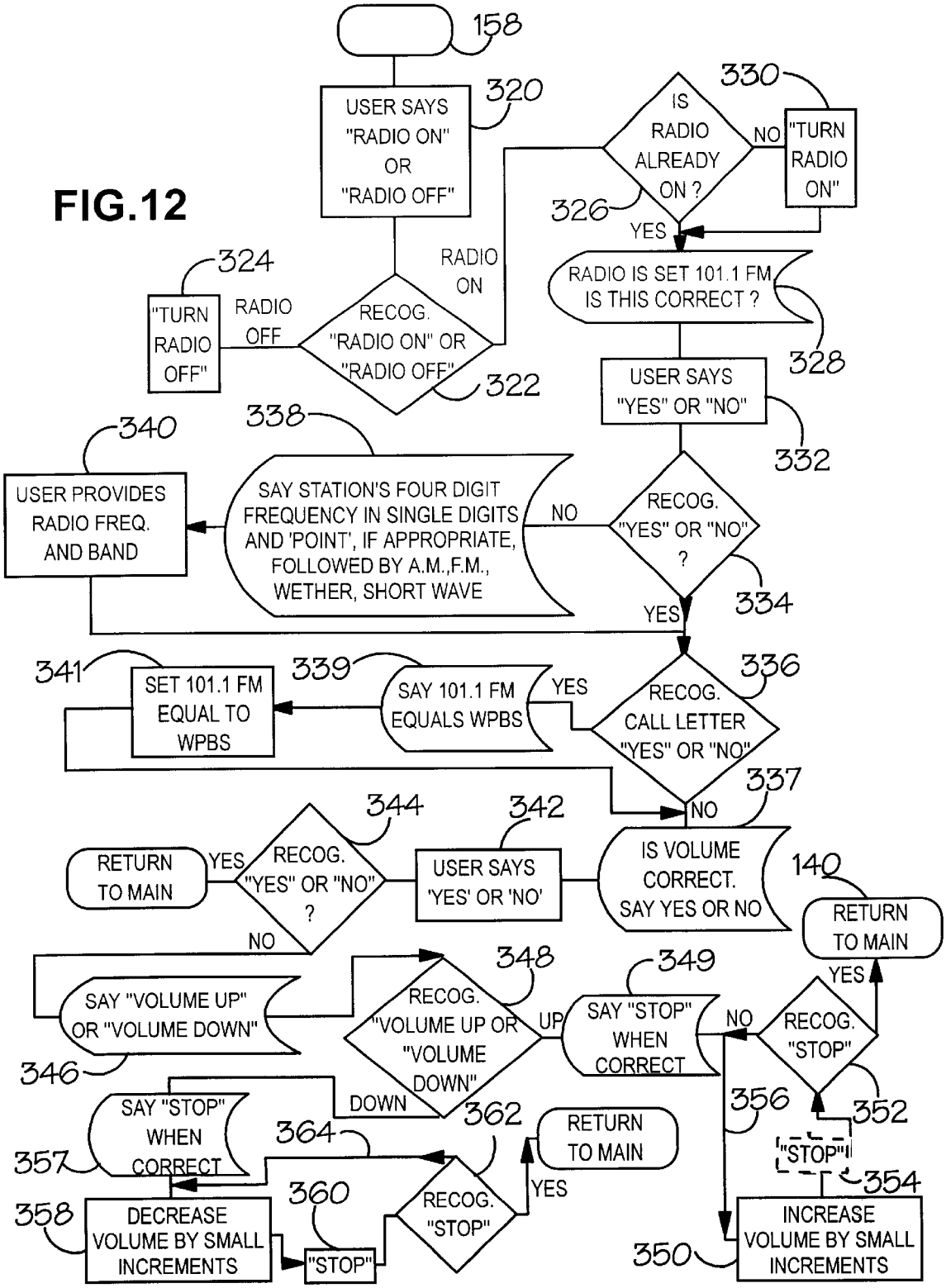

Referring now to FIGS. 5, 6 and 12, it will be recalled that one of the options was to turn the radio on by a verbal command as indicated in block 123 of FIGS. 5 and 6. As shown in FIG. 12, to enter the start point 158 of this subroutine, the user speaks one of the phrases "radio on" or "radio off" as indicated by block 320. If the speaker speaks the phrase "radio off" the logic block 322 will actuate circuitry to provide a digital signal to turn the radio off as indicated in block 324 and was discussed with respect to FIG. 5. However, if the program subroutine in FIG. 12 recognizes the phrase "radio on" then the program proceeds to tune the radio to the desired station as to set the volume. Therefore, the "radio on" output goes to logic block 326 which determines if the radio is "on" or "off." If the radio is already "on," the program progresses to the statement made by the voice synthesizer, "Radio is set for 101.1 FM. Is this correct?" as indicated in block 328. However, if the output of logic step 326 is "no," the radio will be turned on as shown at step 330 and the program will then be directed to step 328. The user will then state "yes" or "no" to indicate whether or not the station should be changed as shown in step 332. Logic step 334 will recognize a "yes" or "no" and, if "yes," the program goes to a recognize "CALL LETTERS" logic block 336. If the answer is "no," the user will be instructed by the speech synthesis circuitry at step 338 to "Say station, four digit frequency in single digits with "point" followed by "AM," "FM," "WPBS," "Weather" or "Short Wave". The user will then state the digits one at a time and indicate whether the station should be an AM, FM, weather or short wave station as indicated at step 340. It will be appreciated that steps 338 and 340 are actually several steps which progress and operate very similar to the steps included by dashed lines 308 for setting the time and alarm in FIGS. 9, 10 and 11. Once the station is properly set, the program will advance to the recognize "CALL LETTERS" step 336. If the response is "no," the program progresses to the "Volume Correct?" step 337. If the answer is "yes," the user identifies the station by its call letters, or any other coded name, such as, for example, "Peach," "Weather," "Sports," etc., for which the voice recognition circuitry has been trained as an optional phrase such as shown in step 339. The program then advances to the "Volume Correct?" step 337. As shown in step 337, the speech synthesis states, "Is volume correct?" Then, at step 342, the user will say "yes" or "no." Logic block 344 will recognize a "yes" or "no" and, if "yes," the program will return to the main point 140. If the answer is "no," the user states either "Volume up" or "Volume down" as shown in step 346. If logic block 348 recognizes "volume up," the speech synthesis circuitry will state "Say stop when correct," as shown in step 349, and then the digital radio control circuitry will increase the radio volume a small but selected increment as shown at step 350. After the increase, the speech recognition program will determine at block 352 if the user has spoken the word "stop" as indicated in the dashed line block 354. If the user has spoken the word "stop," the program returns to the main point 140. If the user has not spoken the word "stop," the program loops back to step 350 as indicated by line 356, and the volume will be incrementally increased until the user speaks the word "stop" or the volume goes to maximum.

If logic block 348 determines the radio volume is to be decreased, the program progresses substantially the same as for a volume increase except step 358 will incrementally decrease the volume, the rest of the program for detecting whether the word "stop" has been spoken is the same as indicated by the steps 357, 360,362 and 364.

Figure 13:
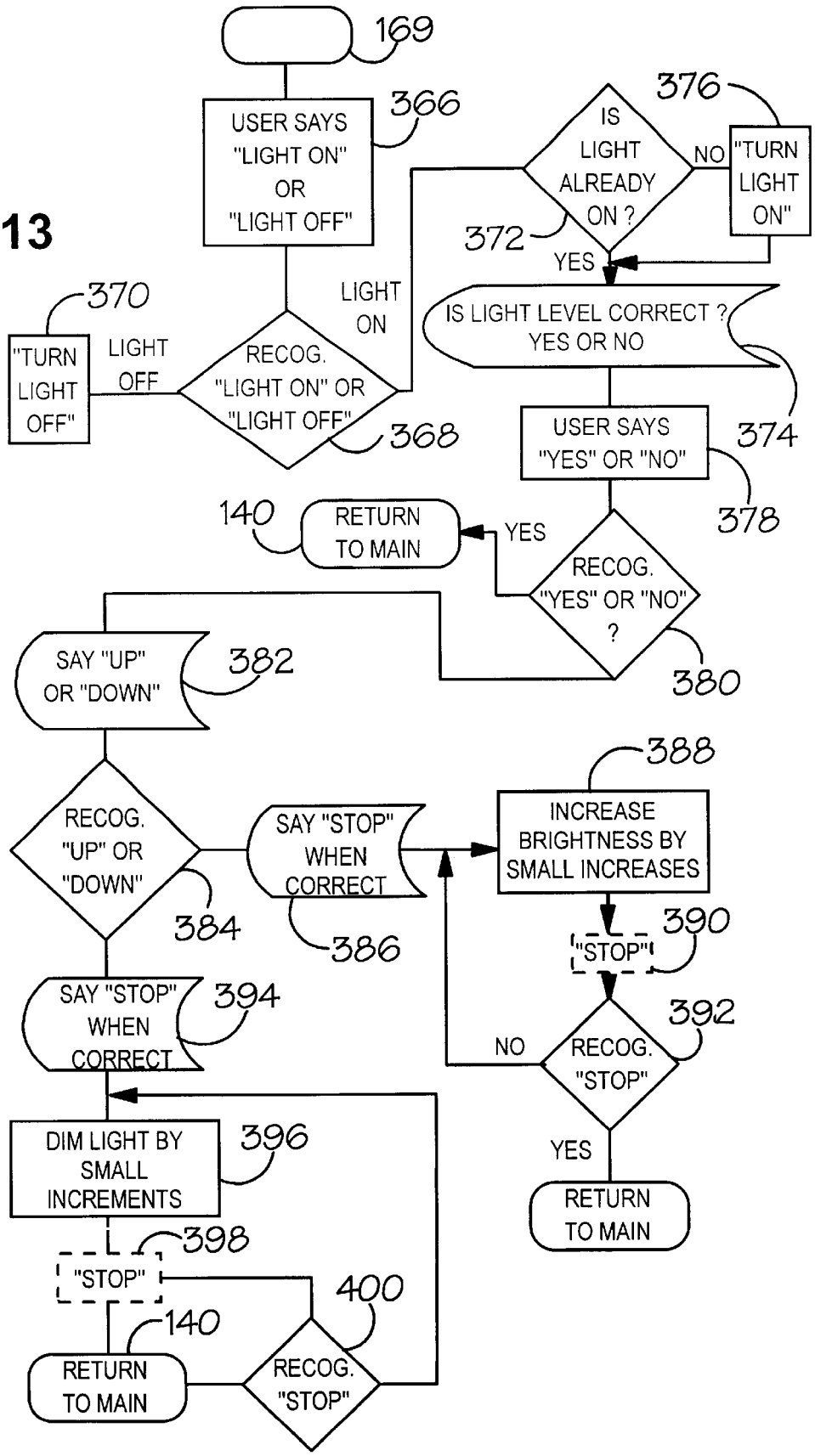

The present invention further includes circuitry for allowing a light to be turned "ON" or "OFF" and for controlling the brightness independent of the go-to-sleep mode or clock alarm as discussed above. As shown in FIG. 13, a user may verbally request that a light be turned "on" or "off" as indicated in step 366. Logic block 368 will recognize a phrase "light on" or "light off." If the phrase "light off" is recognized and the lamp is "on," the lamp will be turned off as indicated at step 370. Of course, if the light is already off, no action is taken. However, if logic recognizes a "light on" phrase, the program progresses to logic block 372 to determine if the light is already "on." If it is already "on," the program progresses to the speech synthesis statement block 374, if the light is off, the program branches to action step 376 and the lamp is turned "on" and then returns to statement block 374. Statement block 374 asks whether or not the brightness level is correct and instructs the user to say "yes" or "no" as indicated by step 378. If logic block 380 recognizes a "yes," the program returns to the main starting point 140. If logic block recognizes a "no" response, the program proceeds to statement block 382 which instructs the user to say "up" or "down" ("bright" or "dim" or other similar terms could of course be used).

If logic block 384 recognizes "up," the program goes to a statement block 386 which instructs the user to say "stop"

when the brightness level is correct. The light level is then increased a small selected increment as indicated by action block 388. The program then listens for the spoken command "stop" as indicated in the dashed block 390 and if it recognizes "stop" at logic block 392, the program returns to main start point 140. If "stop" is not spoken, the program loops back to block 388 for another incremental increase of the brightness level. This loop continues until the command "stop" is spoken or the light is turned full on.

If logic block 384 recognizes a spoken "down" command, the light proceeds in the same manner as indicated by program step 394, 396, 398 and 400 except the light is incrementally decreased until the "stop" command is spoken or the light level is decreased to the "off" level.

It will also be recalled from FIGS. 5 and 6 that it is possible to completely retrain the system in the event the clock radio is sold, given away or just to be used by different users.

Figure 14:
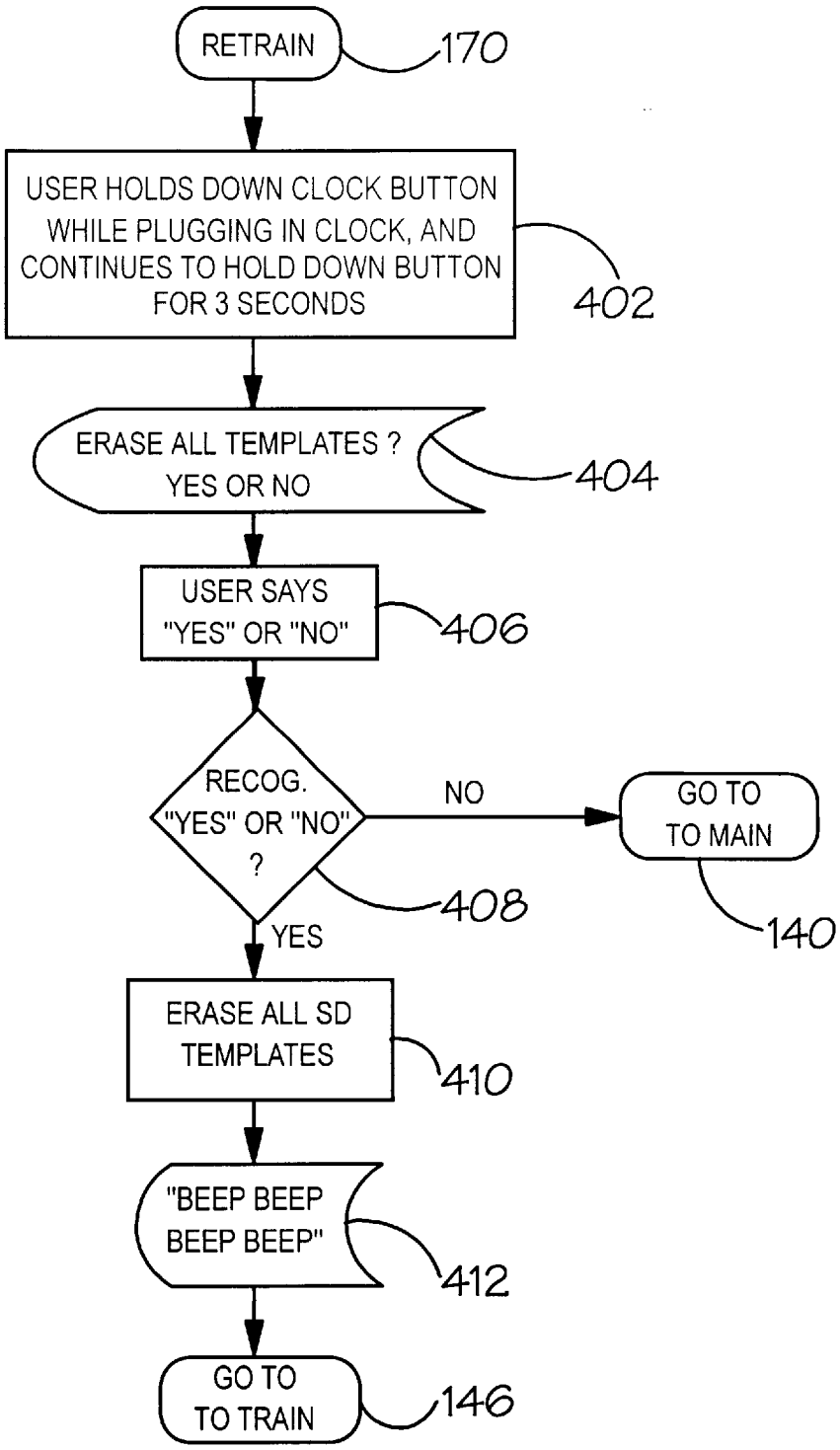
–FIG. 14 shows a detailed flow diagram for performing the processes illustrated in FIG. 5.

Referring now to FIG. 14, the logic diagram for retraining is discussed. As was indicated by the dotted line to the retrain block 170 of FIG. 5, according to one embodiment, this process is not initiated by a verbal command nor by a normal press selection of a switch, etc. As was discussed, to retrain the system and as is shown in FIG. 13 at block 402, the user unplugs the clock and then holds down the snooze button 48 while plugging in the clock and continues to hold down the snooze button for at least three seconds as indicated by block 402. The speech synthesis portion of the computer will then make the statement "Erase all templates? Yes or No" as indicated by block 402. The user will then make the statement "yes" or "no" as indicated by block 406 and the program will progress to the decision block 408 after evaluating the user's phrase. If the user has made the statement "no" the program will simply go back to the main menu at 140 with no changes in the data stored in memory. However, if the phrase "yes" is recognized, the computer will then proceed to erase all of the speaker dependent memory templates as indicated in block 410, and will make a distinct recognizable sound such as four beeps in a row as indicated in block 412 and then proceed to the training subroutine 146 as was discussed with respect to FIG. 7. Of course, rather than unplugging, replugging and using the snooze button 48, a dedicated button (preferably located in an obscured location) could be used to direct the program to block 402.

The corresponding structures, materials, acts, and equivalents of all means or step plus function elements in the claims below are intended to include any structure, material, or act for performing the function in combination with other claimed elements as specifically claimed.

What is claimed is:

1. An interactive voice recognition and voice synthesis digital clock, comprising:

a DC source of power;

a microphone for converting audible human speech into first electrical signals representing said human speech;

a source of periodic pulse signals for use as clocking signals;

a microprocessor connected to said microphone, said DC source of power, and connected to receive said clocking signals, said microprocessor including:

clocking circuitry for providing second electrical signals for controlling at least the time indicated by a digital clock display, speech synthesis circuitry for generating third electrical signals representative of selected output speech phrases in response to receiving selected control signals, input speech circuitry for receiving and analyzing said first electrical signals, and said microprocessor generating said selected control signals for controlling outputs of said clocking circuitry and said speech synthesis circuitry in response to said analyzing of said first electrical signals, said microprocessor providing first ones of said selected control signals if said speech circuitry failed to recognize said first electrical signals as representing a predetermined input speech phrases and providing second ones of said selected control signals if said speech circuitry recognizes said first electrical signals as representing a predetermined input speech phrase, first memory cooperating with said microprocessor for storing data required by said microprocessor to process said first electrical signals and to determine if at least a part of said first electrical signals represents at least one of said predetermined input speech phrases;

second memory cooperating with said speech synthesis circuitry of said microprocessor for storing data required to generate said third electrical signals in response to receiving said first ones of said selected control signals;

a sound producing device connected to said microprocessor for receiving said third electrical signals from said speech synthesis circuitry and for converting said electrical signals into audible sounds representative of said output phrases; and a digital display for receiving said second electrical signals from said clocking circuit and for providing a clock display.

2. The device of claim 1 wherein said sound producing device is an audio speaker system and wherein at least one of said second electrical signals generated by said clocking circuitry is an "on" control signal which occurs at a selected time, and further comprising a sound or alarm device connected to said microprocessor for generating electrical sound or alarm signals in response to said "on" control signal, said electrical sound or alarm signals connected to said speaker system so as to provide an audible sound or alarm.

3. The device of claim 2 wherein said clocking circuitry generates at least two "on" signals, each "on" signal generated at a different time.

4. The device of claim 2 wherein said alarm device is a radio and said microprocessor further includes radio control circuitry for generating control signals for turning said radio on and off, and for tuning said radio to selected stations in response to said microprocessor receiving selected ones of said predetermined input speech phrases.

5. The device of claim 4 wherein said clocking circuitry generates a signal to turn said radio "off" after a selected period of time.

6. The device of claim 2 wherein said alarm device generates an intermittent 400 Hz tone with three ascending output levels.

7. The device of claim 5 wherein said signal to turn said radio "off" is generated at a selected time period after being turned on in response to a recognized input speech phrase to provide a "go-to-sleep" mode.

8. The device of claim 5 wherein said signal to turn said radio "off" is generated at a selected time period after being turned on in response to the "on" signal from said clocking circuitry.

9. The device of claim 1 wherein said microprocessor further includes training circuitry for receiving selected spoken phrases and for providing a portion of the data stored in said first memory.

10. The device of claim 1 wherein said digital display includes display drivers for a four digit clock display.

11. The device of claim 1 wherein at least one of said first and second memories are integral with said microprocessor.

12. The device of claim 1 wherein said DC power source receives AC line power and converts said line power to DC power and further including an output unit connected to said AC line power, said output unit further connected to said microprocessor for receiving control signals, and wherein said microprocessor includes light control circuitry for providing said control signals to said output unit so as to turn power on and/or off at said output unit and to control the available power for use at said output unit.

13. The device of claim 1 wherein said selected output speech phrase in response to said first ones of said selected control signals indicates that said audible human speech converted by said microphone was not recognized as a predetermined input speech phrase.

14. The device of claim 1 wherein a portion of said predetermined input speech phrases are multiword phrases.

15. The device of claim 1 wherein said input speech circuitry is speaker dependent with respect to selected ones of said predetermined input speech phrases such that said circuitry only recognizes the speech of a selected number of specific individuals saying said selected ones of said predetermined input speech phrase.

16. An interactive voice recognition and voice synthesis digital clock, comprising:

a DC source of power;

a microphone for converting audible human speech into first electrical signals representing said human speech;

a source of periodic pulse signals for use as clocking signals;

a microprocessor connected to said microphone, said DC source of power, and connected to receive said clocking signals, said microprocessor including:

clocking circuitry for providing second electrical signals for controlling at least the time indicated by a digital clock display, speaker dependent input speech circuitry for receiving said first electrical signals and for recognizing predetermined input speech phrases contained in said audible human speech only from a limited number of specific individuals and upon recognizing a predetermined phrase spoken by one of said specific individuals, said speech circuitry generating third electrical signals for controlling selected functions of said clocking circuitry, speech synthesis circuitry for generating fourth electrical signals representative of selected output speech phrases in response to said received first electrical signals not being recognized as one of said predetermined input speech phrases;

first memory for storing data required by said input speech circuitry to process said first electrical signals and to determine if at least a part of said first electrical signals represents at least one of said predetermined input speech phrases;

second memory cooperating with said speech synthesis circuitry of said microprocessor for storing data required by said speech synthesis circuitry to generate said fourth electrical signals;

a sound producing device connected to said microprocessor for receiving said fourth electrical signals from said speech synthesis circuitry and for converting said electrical signals into audible sounds representative of said output phrases; and a digital display for receiving said second electrical signals from said clocking circuit and for providing a clock display.

17. The device of claim 16 wherein said sound producing device is an audio speaker system and wherein at least one of said second electrical signals generated by said clocking circuitry is an "on" control signal which occurs at a selected time, and further comprising a sound or alarm device connected to said microprocessor for generating electrical sound or alarm signals in response to said "on" control signal, said electrical sound or alarm signals connected to said speaker system so as to provide an audible sound or alarm.

18. The device of claim 17 wherein said clocking circuitry generates at least two "on" signals, each "on" signal generated at a different time.

19. The device of claim 17 wherein said alarm device is a radio and said microprocessor further includes radio control circuitry for generating control signals for turning said radio on and off, and for tuning said radio to selected stations in response to said microprocessor receiving selected ones of said predetermined input speech phrases.

20. The device of claim 19 wherein said clocking circuitry generates a signal to turn said radio "off" after a selected period of time.

21. The device of claim 20 wherein said signal to turn said radio off is generated at a selected time period after said radio is turned on in response to a recognized input speech phrase to provide a "go-to-sleep" mode.

22. The device of claim 20 wherein said signal to turn said radio off is generated at a selected time period after said radio is turned on in response to the "on" signal from said clocking circuitry.

23. The device of claim 16 wherein said microprocessor further includes training circuitry for receiving selected spoken phrases and for providing a portion of the data stored in said first memory.

24. The device of claim 16 wherein said digital display includes display drivers for a four digit clock display.

25. The device of claim 16 wherein at least one of said first and second memories are integral with said microprocessor.

26. The device of claim 16 wherein said DC power source receives AC line power and converts said line power to DC power and further including an output unit connected to said AC line power, said output unit further connected to said microprocessor for receiving control signals, and wherein said microprocessor includes light control circuitry for providing said control signals to said output unit so as to turn power on and/off at said output unit and to control the available power for use at said output unit.

* * * * *